US005558979A

United States Patent [19]

Ishigaki et al.

[11] Patent Number: 5,558,979

[45] Date of Patent: Sep. 24, 1996

[54] SILVER HALIDE PHOTOGRAPHIC MATERIAL

[75] Inventors: Kunio Ishigaki; Takashi Naoi, both of Kanagawa, Japan

[73] Assignee: Fuji Photo Film Co., Ltd., Kanagawa, Japan

[21] Appl. No.: 392,329

[22] Filed: Feb. 22, 1995

[30] Foreign Application Priority Data

Feb. 22, 1994 [JP] Japan ..... 6-046606

[51] Int. Cl.[6] ..... G03C 1/795

[52] U.S. Cl. ..... 430/531; 430/523; 430/539; 430/502

[58] Field of Search ..... 430/523, 531, 430/539, 502

[56] References Cited

U.S. PATENT DOCUMENTS

| | | | |
|---|---|---|---|
| H874 | 1/1991 | Suzuki et al. | 430/539 |
| 5,188,930 | 2/1993 | Funaki et al. | 430/531 |
| 5,206,120 | 4/1993 | Hayashi | 430/376 |
| 5,206,128 | 4/1993 | Arai | 430/537 |
| 5,206,134 | 4/1993 | Yamada et al. | 430/569 |
| 5,213,953 | 5/1993 | Yamamoto | 430/569 |

*Primary Examiner*—Lee C. Wright
*Attorney, Agent, or Firm*—Sughrue, Mion, Zinn, MacPeak & Seas

[57] ABSTRACT

A silver halide photographic material which has an excellent dimensional stability and which is easy in the register operation is disclosed. The silver halide photographic material comprises a support having provided thereon at least one silver halide emulsion layer, wherein the total amount of gelatin in the total hydrophilic colloid layers on the side having said emulsion layer and the total hydrophilic colloid layers on the opposite side thereto is 6 g/m$^2$ or less, and the support is a styrene type polymer having a syndiotactic structure.

3 Claims, No Drawings

SILVER HALIDE PHOTOGRAPHIC MATERIAL

FIELD OF THE INVENTION

This invention relates to a silver halide photographic material and, more specifically, to a superhigh-contrast silver halide photographic material used for a photomechanical process.

BACKGROUND OF THE INVENTION

A silver halide photographic material generally comprises a support such as a plastic film, paper or a paper coated with polyethylene having coated thereon a silver halide emulsion layer and, if necessary, various combinations of constituting layers such as an interlayer, a protective layer, a backing layer, an antihalation layer and an antistatic layer.

The silver halide photographic material generally comprises a hydrophilic colloid layer such as gelatin as a binder on at least one side of the support. The hydrophilic colloid layer has a defect since it is liable to be expanded and contracted by the change of humidity or temperature.

Variation in the dimension of the photographic material caused by expansion and contraction of the hydrophilic layers is an important defect of the photographic material for printing which requires reproduction of dot images and precise line images for the multi-color print.

In order to obtain a photographic material having less variation in the dimension, i.e., having an excellent dimensional stability, a technique for regulating a thickness ratio of the hydrophilic colloid layers and the support is disclosed in U.S. Pat. No. 3,201,250, and a technique for incorporating a polymer latex into the hydrophilic colloid layers is disclosed in JP-B-39-4272, JP-B-39-17702, JP-B-43- 13482 and JP-B-45-5331 (the term "JP-B" as used herein means an examined Japanese patent publication), and U.S. Pat. Nos. 2,376,005, 2,763,625, 2,772,166, 2,852,386, 2,853,457, 3,397,988, 3,411,911 and 3,411,912. Also, the theoretical background of the above-described techniques is described in J. Q. Umberger, *Photo. Sci. and Eng.* (1957) pages 69–73.

Further, a technique for coating a polyester film support with a vinylidene chloride copolymer is disclosed in U.S. Pat. Nos. 4,645,731, 4,933,267 and 4,954,430. Furthermore, a technique using a low humidity drying and a heat-treatment is disclosed in JP-A-1-229240 and JP-A-1-229244 (the term "JP-A" as used herein means an unexamined published Japanese patent application).

However, in recent years, high precision printing have been used more and more, and a further improvement in the dimensional stability of the photographic material is strongly desired. Generally, polyester type polymers, typically, polyester terephthalate (hereinafter referred to as "PET") are used as plastic supports of the silver halide photographic materials used for the photomechanical process. PET films have excellent characteristics in dimensional stability, mechanical strength and producibility and hence have been widely used.

However, even when the conventional technique for improving the dimensional stability is used, the PET film still does not sufficiently fulfil the requirements for the precision printing.

Films of styrene type polymer having a syndiotactic structure with a low coefficient of moisture swelling (hereinafter referred to as "SPS") as compared with the polyester film is disclosed in JP-A-3-131843. The silver halide photographic material for the photomechanical process using the SPS film as a support has an improved register of a plurality of plates in the multi-color print, but is still insufficient for the high precision printing.

Poor register in the photomechanical process is caused by various complicated factors such as variation in the dimension by temperature and moisture, optical characteristics and contact during light-exposure, and variation in the dimension by development processing.

Accordingly, development of a silver halide photographic material which makes the register easy has been strongly desired.

SUMMARY OF THE INVENTION

An object of the present invention is to provide a silver halide photographic material for the photomechanical process which is excellent in the register.

The object of the present invention is achieved by a silver halide photographic material comprising a support having provided thereon at least one silver halide emulsion layer in which a total amount of gelatin in the total hydrophilic colloid layers on the side having the emulsion layer and in the total hydrophilic colloid layers on the opposite side thereto is 6 g/m$^2$ or less, and said support is a styrene type polymer having a syndiotactic structure.

DETAILED DESCRIPTION OF THE INVENTION

First, the SPS film of the present invention is described in detail.

The styrene type polymer having a syndiotactic structure according to the present invention has a steric structure in which phenyl groups or derivatives thereof as side chains are located alternately in opposite directions with respect to the main chain formed by carbon—carbon bonds, and the tacticity thereof quantitatively determined by the nuclear magnetic resonance method by a carbon isotope ($^{13}$C-NMR method) is generally performed and excellent in the accuracy. The tacticity measured by the $^{13}$C-NMR method can be represented by the proportion of a plurality of continued constituting units, for example, diad in the case of 2 units, triad in the case of 3 units and pentad in the case of 5 units. The term "styrene type polymer having a syndiotactic structure" as used herein means that having the tacticity of 75% or more, preferably 85% or more in racemic diad, or 30% or more, preferably 50% or more in racemic pentad. More specifically, the term indicates a tactic polystyrene, poly(alkylstyrene), poly(halogenated styrene), poly(halogenated alkylstyrene), poly(alkoxystyrene), poly(vinyl benzoate), and a hydrogenated polymer thereof and a mixture thereof, or a copolymer containing these structural units.

Examples of the poly(alkylstyrene) include poly(methylstyrene), poly(ethylstyrene), poly(propylstyrene), poly(butylstyrene), poly(phenylstyrene), poly(vinylnaphthalene), poly(vinylstyrene) and poly(acenaphthylene), examples of poly(halogenated styrene) include poly(chlorostyrene), poly(bromostyrene) and poly(fluorostyrene), and examples of poly(alkoxystyrene) include poly(methoxystyrene) and poly(ethoxystyrene).

Examples of comonomers in the copolymers containing the above structural units include, in addition to the above-described styrene type polymers, an olefin monomer such as ethylene, propylene, butene, hexene and octene, a diene monomer such as butadiene and isoprene, a cyclic olefin monomer, a cyclic diene monomer, and a polar vinyl monomer such as methyl methacrylate, maleic anhydride and acrylonitrile.

Of these, particularly preferred styrene type polymers include polystyrene, poly(alkylstyrene) and hydrogenated polystyrene, and copolymers containing these structural units.

The molecular weight of the styrene type polymer is not specifically limited, but the weight-average molecular weight thereof is preferably from 10,000 to 3,000,000, and more preferably from 50,000 to 500,000. The molecular weight distribution is not restricted as to its broadness or narrowness, and various distributions can be applied. However, the weight-average molecular weight (Mw)/the number-average molecular weight (Mn) is preferably from 1.5 to 8. The styrene type polymer having the syndiotactic structure is markedly excellent in the heat-resistance as compared with the conventional styrene type polymer having an atactic structure.

Such styrene type polymers having a syndiotactic structure can be prepared by, for example, polymerizing a styrene type monomer (the monomer corresponding to the above-described styrene type polymer) in an inert hydrocarbon solvent or in the absence of solvents and in the presence of a titanium compound and a condensation product of water and an trialkyl aluminum as catalysts (JP-A-62-187708). Alternatively, the polymers can be prepared by polymerization using, as catalysts, a titanium compound and a compound comprising a cation and an anion in which a plurality of groups are bonded to an element (JP-A-4-249504).

In the present invention, the above styrene type polymer is used as a material for the film, but other resin components may be incorporated into the film in a range which does not adversely affect the object of the present invention. Examples of such resins include styrene type polymers having an atactic structure or an isotactic structure, polyphenylene ethers, polyolefins such as polyethylene, polypropylene, polybutene and polypentene, polyesters such as polyethylene terephthalate, polybutylene terephthalate and polyethylene naphthalate, polyamides such as Nylon-6 and Nylon-6,6, polythioethers such as polyphenylene sulfide, polycarbonates, polyacrylates, polysulfones, polyether ether ketones, polyether sulfone, polyimides, halogenated vinyl type polymers such as Teflon, acrylic polymers such as polymethyl methacrylate, polyvinyl alcohols, and crosslinked resins containing the above-described resins.

Further, an inorganic fine particle, an antioxidant, an antistatic agent and a colorant can be incorporated into the styrene type polymer in the range which does not adversely affect the object of the present invention.

The inorganic fine particle which can be used includes oxides, hydrates, sulfides, nitrides, halides, carbonates, acetates, phosphates, phosphites, organic carboxylates, silicates, titanates and borates of an element of the Groups IA, IIA, IVA, VIA, VIIA, VIII, IB, IIB IIIB and IVB of the Periodic Table, and hydrated compounds thereof, complex compounds comprising these compounds as a main component, and natural mineral particles. Specific examples of the inorganic fine particles include compounds of the element of the Group IA such as lithium fluoride and borax (sodium borate hydrated salt), compounds of the element of the Group IIA such as magnesium carbonate, magnesium phosphate, magnesium oxide (magnesia), magnesium chloride, magnesium acetate, magnesium fluoride, magnesium titanate, magnesium silicate, magnesium silicate hydrated salt (talc), calcium carbonate, calcium phosphate, calcium phosphite, calcium sulfate (gypsum), calcium acetate, calcium terephthalate, calcium hydroxide, calcium silicate, calcium fluoride, calcium titanate, strontium titanate, barium carbonate, barium phosphate, barium sulfate and barium phosphite, compounds of the element of the Group IVA such as titanium dioxide (titania), titanium monoxide, titanium nitride, zirconium dioxide (zirconia) and zirconium monoxide, compounds of the element of the Group VIA such as molybdenum dioxide, molybdenum trioxide and molybdenum sulfide, compounds of the element of the Group VIIA such as manganese chloride and manganese acetate, compounds of the element of the Group VIII such as cobalt chloride and cobalt acetate, compounds of the element of the Group IB such as cuprous iodide, compounds of the element of the Group IIB such as zinc oxide and zinc acetate, compounds of the element of the Group IIIB such as aluminum oxide (alumina), aluminum fluoride, aluminosilicate (alumina silicate, kaolin, kaolinite), compounds of the element of the Group IVB such as silicon oxide (silica and silica gel), carbon, graphite and glass, and natural mineral particles such as carnallite, kainite, mica (mica and phlogopite) and pyrolusite.

The SPS film according to the present invention comprises the above-described materials, and has a thickness of from 20 to 500 μm and a haze of 3% or less. In order to obtain a film having the thickness and the haze in the above ranges, a material having a relatively slow crystallization rate is suitable.

Of the above-described styrene type polymers, those having a slow crystallization rate are random copolymers and include those having a copolymerizable component other than styrene of 30 mol % or less, for example, a styrene-alkylstyrene copolymer. In this case, the content of the alkylstyrene unit is from 1 to 30 mol %, preferably from 1 to 20 mol % and more preferably from 1 to 15 mol %.

Further, in the present invention, in order to obtain the film having the above-described properties, a residual styrene monomer in the styrene type polymer or a composition thereof is preferably 7000 ppm or less. Such a styrene type polymer or a composition thereof can be obtained by the following method.

(1) A method of drying a styrene type polymer under reduced pressure after polymerization or after further processings. In drying under reduced pressure, a good efficiency can be obtained by adjusting the drying temperature at or higher than the glass transition temperature of the polymer.

(2) In addition, the polymer is degassed by an extruder and, at the same time, is formed into a material for molding (pellets). The extruder used is preferably equipped with a vent, and either uniaxial or biaxial extruder may be used.

The content of a residual monomer volatile component exceeding 7000 ppm is not preferred since it may result in foaming during the extrusion molding and roughening of the film surface during the stretching whereby a haze may exceeds 3%.

A film is prepared using as a raw material the above-described styrene type polymer of the present invention or a composition containing the polymer. The method for the preparation of the film may be performed under any conditions which achieve the above object, and is not specifically limited. More specifically, the film can be prepared by extruding the heat-molten-material, cooling and solidifying. Either uniaxial or biaxial extruding-molding machine can be used, with or without a vent being provided. It is preferred to use an appropriate mesh filter in the extruder for grinding and removing a secondary aggregated particles or removing dusts or foreign materials.

The extrusion conditions used are not specifically restricted and may be appropriately selected according to various situations, but the extrusion is preferably conducted in a temperature range of 50° C. higher than the melting point to the decomposition temperature of the styrene type polymer to be extruded and using a T-die.

After the molding by extrusion, the resulting preparatory molded material (a raw sheet) is cooled and solidified. Any of cooling media such as a gas, a liquid and a metal roll can be used. When the metal roll is used, the procedure by an air-knife, an air chamber, a touch roll or an electrostatic application is effective for preventing irregular thickness and waviness.

The temperature for the cooling and sodifying is generally in the range of from 0° C. to a temperature 30° C. higher than the glass transition temperature of the raw sheet, and preferably in the range of from a temperature 50° C. lower than the glass transition temperature to the glass transition temperature. Further, a cooling rate is appropriately selected in the range of from 200° to 3° C./second. The raw sheet thus obtained has a thickness in the range of from 100 to 5,000 μm.

Then, the cooled and solidified raw sheet is uniaxially or biaxially stretched. In the biaxial stretching, the sheet may be stretched simultaneously in the lengthwise direction and the crosswise direction or may be stretched successively in any order. Also, the stretching may be carried out in a single step or in a multiple step.

There are various stretching methods such as a method by a tenter, a method of stretching between rolls, a method by a bubbling by utilizing a gas pressure and a method by rolling, and a suitable stretching method can be appropriately selected or a combination of these methods can be applied. The stretching temperature can be generally adjusted between the glass transition temperature and the melting point of the raw sheet.

However, in the case of the successive stretching or the multiple stretching process, it is preferred that the first stage is carried out in the range of from the glass transition temperature and the cold crystallization temperature, and subsequent stages are carried out in the range of from the glass transition temperature and the melting point. The stretching rate is generally from 1×10 to $1\times10^7$%/minute, preferably from $1\times10^3$ to $1\times10^7$%/minute.

The area percent of stretch is 8 times or more, preferably 10 times or more. At an area percent of stretch below 8 times, it is difficult to obtain a film having a satisfactory transparency and smoothness, heat-absorption dimensional stability, and thermal dimensional stability.

The stretched film obtained by stretching under the above-described conditions is preferably further subjected to a heat-fixing for improving the dimensional stability at a high temperature, heat-resistance, strength balance of the film inside. The heat-fixing may be performed by a usual method, for example, by maintaining the stretched film in a strain state, a loose state or a limited shrunk state at a temperature in the range of from the glass transition temperature to the melting point of the film, preferably from the upper limited temperature under use condition to the melting point thereof for a period of from 0.5 to 1880 seconds. The heat-fixing may be conducted twice or more under different conditions within the above-described ranges. Also, the heat-fixing may be conducted in an inert gas atmosphere such as argon or a nitrogen gas. In order to obtain a film having a low heat-shrinkage, any of the heat-fixing steps is preferably conducted under a limited shrinkage condition, and the proportion of the limited shrinkage is 20% or less, preferably 15% or less, in the longitudial direction and/or the lateral direction.

Further, it is preferred that the stretching and heat-fixing conditions are controlled in such a manner that the absolute value of birefringence $|\Delta n|$ of the film is adjusted to $40\times10^{-3}$ or less whereby a film having excellent physical properties such as transparency can be obtained.

PREPARATION EXAMPLE 1

(1) Preparation of Contact Product of Trimethyl Aluminum and Water 17.8 g (71 mmol) of copper sulfate pentahydrate ($CuSO_4 \cdot 5H_2O$), 200 ml of toluene and 24 ml (250 mmol) of trimethyl aluminum were charged into a 500 ml volume glass container substituted with argon, and reacted at 40° C. for 8 hours. Thereafter, toluene was distilled off from the solution obtained after removing a solid portion to obtain 6.7 g of a contact product. The molecular weight of the resulting contact product was determined by a solidifying point depression method and found to be 610.

(2) Preparation of Styrene Polymer

A polymerization reaction was conducted using 950 ml of purified styrene, 50 ml of p-methylstyrene, the contact product obtained in the above (1) in an amount of 5 mmol as aluminum atom, 5 mmol of triisobutyl aluminum and 0.025 mmol of pentamethylcyclopentadienyl titanium trimethoxide in a 2-liter volume reactor at 90° C. for 5 hours. After completion of the reaction, the catalyst components in the resulting product were decomposed in a methanolic solution of sodium hydroxide, and, after repeatedly washing with methanol, the product was dried to obtain 308 g of a polymer.

The resulting copolymer was confirmed by $^{13}$C-NMR to contain 9.5 mol % of a p-methylstyrene unit in a co-syndiotactic structure. Also, the weight-average molecular weight of the product was 438,000 and a ratio of weight-average molecular weight/number-average molecular weight was 2.51.

PREPARATION EXAMPLE 2

Preparation of Styrene Polymer (Reference Example 2 of JP-A-1- 316246)

Six liters of toluene as a reaction solvent, 5 mmol of tetraethoxy titanium and 500 mmole as an aluminum atom of methyl aluminoxane were charged into a reaction vessel, and 48.75 mol of styrene and 1.25 mol of p-methylstyrene were added thereto at 50° C., followed by conducting a polymerization reaction for 2 hours.

After completion of the reaction, the product was washed with a mixed solution of hydrochloric acid and methanol to decompose and remove the catalyst components. Then, the product was dried to obtain 640 g of a copolymer. The resulting copolymer had a weight-average molecular weight of 440,000, a number-average molecular weight of 240,000 and a melting point of 255° C. A ratio of a p-methylstyrene unit content in the copolymer was 5 mol %. Also, the analysis by $^{13}$C-NMR of this copolymer showed absorptions at 145. 11 ppm, 145. 22 ppm, and 142. 0.9 ppm, and syndiotacticity at a racemic pentad of the styrene unit calculated from the peak areas thereof was 72%.

In order to strongly adhere hydrophilic colloid layers using gelatin as a main binder (for example, a silver halide emulsion layer, an antihalation layer, an interlayer and a backing layer) to the SPS film support according to the present invention, the following conventionally known method can be used.

(1) A method for obtaining an adhesive force by subjecting the support to a surface activation treatment such as a chemical treatment, a mechanical treatment, a corona discharge treatment, a flame treatment, a ultraviolet ray treatment, a high frequency treatment, a glow discharge treatment, an active plasma treatment, a laser treatment, a mixed acid treatment and an ozone oxidation treatment, followed by coating a photographic emulsion directly.

(2) A method for providing a subbing layer and coating a photographic emulsion layer thereon in an alternative procedure, i.e., after conducting the above surface treatment or without conducting the surface treatment (for example, U.S. Pat. Nos. 2,698,241, 2,764,520, 2,864,755, 3,462,335, 3,475,193, 3,143,421, 3,501,301, 3,460,944 and 3,674,531, British Patent Nos. 788,365, 804,005 and 891,469, JP-B-48-43122 and JP-B-51- 446).

These surface treatments are considered to form more or less polar groups on the surface of the support which is inherently hydrophobic and to increase a crosslinking density of the surface. As a result, it is considered that an affinity to polar groups of the components contained in the subbing layer increases or a fastness of the adhesion surface increases.

Further, various devices have been considered in constructions of the subbing layer, and such constructions include a so-called double layer method in which a highly adhesive layer to the support is provided as a first layer (hereinafter, referred to the first subbing layer) and a highly adhesive hydrophilic resin layer to a photographic layer is coated thereon as a second layer (hereinafter, referred to the second subbing layer), and a single layer method in which a single resin layer containing both hydrophobic groups and hydrophilic groups is coated.

Of the surface treatments in (1), the corona discharge treatment is the most well-known method and can be carried out by any of the conventional methods, for example, the methods disclosed in JP-B-48-5043, JP-B-47-51905, JP-A-47-28067, JP-A- 49-83767, JP-A-51-41770 and JP-A-51-131576. A suitable frequency of discharge is from 50 Hz to 5000 KHz, preferably from 5 KHz to several 100 KHz. Too low frequency of discharge is not preferred since a stable discharge cannot be obtained and pin holes may be formed in the treated material. On the other hand, too high frequency of discharge is not preferred since a special apparatus is required for impedance matching and the cost of the apparatus increases. With respect to the treating strength of the treated material, improvement in the wettability of plastic films such as ordinary polyesters and polyolefins is suitably achieved at from 0.001 KV.A.minute/$m^2$ to 5 KV.A.minute/$m^2$, preferably from 0.01 KV.A.minute/$m^2$ to 1 KV-A.minute/$m^2$. A suitable gap clearance between the electrodes and the guide material roll is from 0.5 to 2.5 mm, preferably from 1.0 to 2.0 mm.

In many cases, the glow discharge treatment which is the most effective surface treatment can be conducted by any of the conventional methods, for example, the method disclosed in JP-B-35-7578, JP-B-36-10336, JP-B-45-22004, JP-B-45-22005, JP-B- 45-24040 and JP-B-46-43480, U.S. Pat. Nos. 3,057,792, 3,057,795, 3,179,482, 3,288,638, 3,309,299, 3,424,735, 3,462,335, 3,475,307, 3,761,299, British Patent No. 997.093 and JP-A-53-129262.

Conditions suitable for the glow discharge are generally a pressure of from 0.005 to 20 Torr, preferably from 0.02 to 2 Torr. If the pressure is too low, the effect of the surface treatment is reduced, and, if the pressure is too high, an excessive electric current is passed, dangerous spark may occur, and the material treated is liable to be destroyed. The discharge is induced by applying a high voltage between a pair or more of metal plates or metal rods positioned with a space in a vacuum tank. The voltage can be varied depending upon the composition of atmospheric gas and the pressure, but generally in the above-described pressure range, a stable constant glow discharge occurs between 500 and 5000 V. A particularly preferred voltage for improving adhesiveness of the surface ranges from 2000 V to 4000 V.

Further, a suitable discharging frequency is from a direct current to several 1000 MHz, preferably from 50 Hz to 20 MHz, as ordinary used in the conventional technique. Regarding the strength of discharge treatment, from 0.01 KV.A.minute/$m^2$ to 5 KV.A. minute/$m^2$ and preferably from 0.15 KV.A.minute/$m^2$ to 1 KV.A. minute/$m^2$ are suitable since the desired adhesion performance can be obtained.

To describe the undercoating methods (2), any of these methods has been well investigated, and, as the first subbing layer in the multi-layered method, properties of a copolymer comprising a starting material, for example, a monomer selected from vinyl chloride, vinylidene chloride, butadiene, methacrylic acid, acrylic acid, itaconic acid and maleic anhydride, as well as a number of polymers such as polyethyleneimine, an epoxy resin, a grafted gelatin and nitrocellulose, and, as the second subbing layer, properties of mainly gelatin have been studied.

In the single layer method, a good adhesiveness is achieved in many cases by swelling many types of supports and interfacial mixing of the hydrophilic undercoating polymer.

Examples of hydrophilic undercoating polymers used in the present invention include water-soluble polymers, cellulose esters, latex polymers and water-soluble polyesters. The water-soluble polymers include gelatin, a gelatin derivative, casein, agar, sodium alginate, a starch, polyvinyl alcohol, a polyacrylic acid copolymer and a maleic anhydride copolymer. Examples of the cellulose esters include carboxymethyl cellulose and hydroxyethyl cellulose. Examples of the latex polymers include a vinyl chloride-containing copolymer, a vinylidene chloride-containing copolymer, an acrylate-containing copolymer, a vinyl acetate-containing copolymer and a butadiene-containing copolymer. Of these polymers, the most preferred is gelatin.

Examples of compounds for swelling the support used in the present invention include resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate.

Various gelatin hardening agents can be used for the subbing layer of the present invention.

Examples of the gelatin hardening agents include chromium salts (such as chromium alum), aldehydes (such as formaldehyde and glutaraldehyde), isocyanates, active halogen compounds (such as 2,4-dichloro-6-hydroxy-s-triazine), epichlorhydrin resins.

The subbing layer of the present invention may contain inorganic fine particles such as $SiO_2$, $TiO_2$ and a matting agent or polymethyl methacrylate copolymer fine particles (from 1 to 10 μm) as a matting agent.

In addition, various additives may be added to an undercoating solution, if necessary. Examples of such additives include a surface active agent, an antistatic agent, an antihalation agent, a coloring dye, a pigment, a coating aid and an antifoggant. In the present invention, when the undercoating solution for the first subbing layer is used, an etching agent such as resorcin, chloral hydrate and chlorophenol need not be contained in the undercoating solution at all. However, if desired, the above-described etching agent may be incorporated into the undercoating solution.

The undercoating solution of the present invention can be coated by a conventional coating method well known in the art, for example, a dip-coat method, an air-knife coat method, a curtain coat method, a roller coat method, a wire-bar coat method, a gravure coat method, or an extrusion coat method using a hopper as described in U.S. Pat. No. 2,681,294. If desired, two or more layers can be coated simultaneously by the method as described in U.S. Pat. Nos. 2,761,791, 3,508,947, 2,941,898 and 3,526,528, and Yuji Harasaki, *Coating Engineering*, p.253 (1973) published by Asakura Shoten.

Gelatin is used as a binder for the silver halide emulsion layers and other hydrophilic colloid layers, but other hydrophilic colloids can be used together. For example, proteins such as gelatin derivatives, graft polymers of gelatin and other polymers, proteins such as albumin and casein, cellulose derivatives such as hydroxyethyl cellulose, carboxymethyl cellulose and cellulose sulfates, saccharides derivatives such as sodium alginate and starch derivatives, and various synthetic hydrophilic high molecular weight materials such as homo- or copolymers, e.g., polyvinyl alcohol, polyvinyl alcohol partially acetal, poly-N-vinylpyrrolidone, polyacrylic acid, polymethacrylic acid, polyacrylamide, polyvinylimidazole, polyvinylpyrazole.

Gelatin may be a lime-treated gelatin and an acid-treated gelatin, and a gelatin hydrolyzate and a gelatin enzyme-decomposate can also be used.

In the present invention, the total coating amount of gelatin as a binder in the total hydrophilic colloid layers on the side having the silver halide emulsion layer and in the total hydrophilic colloid layers on the opposite side thereto is 6 g/m$^2$ or less, and preferably from 2.0 to 6.0 g/m$^2$.

The polymer latex which can be used in the present invention is disclosed in JP-A-64-538, from page 5, upper left column, line 9 to page 12, upper right column, line 16. Examples of specific compounds which can be used are shown below. The numeral in the parenthesis stands for a percent by weight in the copolymer.

K-1

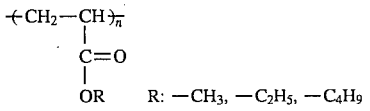

K-2

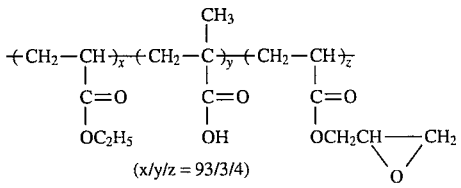

(x/y/z = 93/3/4)

K-3

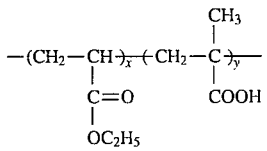

(x/y = 93/7)

K-4

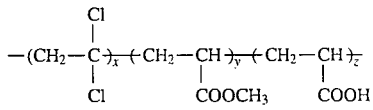

x/y/z = 85/13/2

K-5

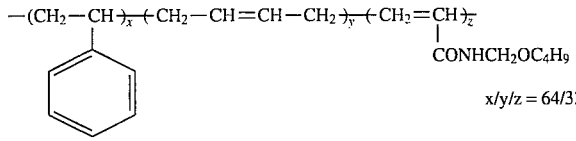

x/y/z = 64/33/3

K-6

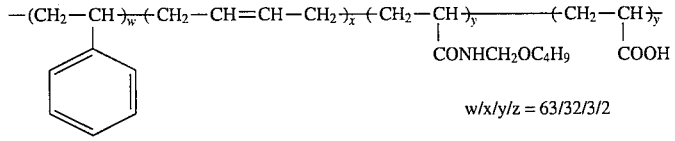

w/x/y/z = 63/32/3/2

K-7

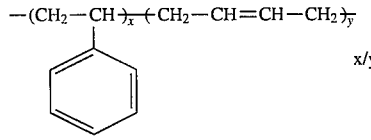

x/y = 67/33

-continued

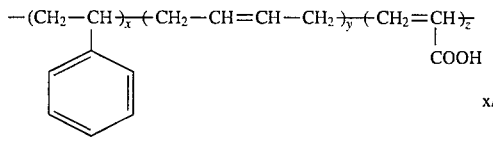

K-8 x/y/z = 59/39/2

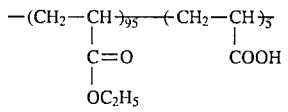

K-9

A particularly preferred polymer latex whose wet film strength is not damaged is that of the polymer represented by the following general formula (1):

$$\text{-}(C)_x\text{-}(A)_y\text{-}(B)_z \quad (1)$$

wherein C represents a repeating unit derived from an ethylenically unsaturated monomer containing active methylene groups, A represents a repeating unit derived from an ethylenically unsaturated monomer other than C and having a glass transition temperature of a homopolymer thereof of 35° C. or below, and B represents a repeating unit derived from an ethylenically unsaturated monomer other than C and A.

x, y and z each represents a weight percent ratio of each of the components, and x is from 0.5 to 40, y is from 60 to 99.5, and z is from 0 to 50, provided that x+y+z represents 100.

To describe in greater detail, the ethylenically unsaturated monomer containing active methylene groups represented by C is represented by the following general formula (2):

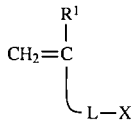

(2)

In the formula (2), $R^1$ represents a hydrogen atom, an alkyl group having from 1 to 4 carbon atoms (e.g., methyl, ethyl, n-propyl and n-butyl) or a halogen atom (e.g., chlorine and bromine), preferably a hydrogen atom, a methyl group or a chlorine atom.

L represents a single bond or a divalent linking group, and specifically is represented by the following formula:

$$\text{-}(L^1)_m\text{-}(L^2)_n$$

wherein $L^1$ represents —CON($R^2$)— (wherein $R^2$ represents a hydrogen atom, an alkyl group having from 1 to 4 carbon atoms or a substituted alkyl group having from 1 to 6 carbon atoms), —COO— —NHCO—, —OCO—,

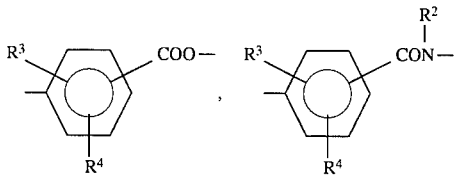

(wherein $R^3$ and $R^4$ each independently represents hydrogen, hydroxyl, a halogen atom or a substituted or unsubstituted alkyl, alkoxy, acyloxy or aryloxy), $L^2$ represents a linking group bonding $L^1$ and X, m represents 0 or 1, and n represents 0 or 1. The linking group represented by $L^2$ is represented by the following general formula:

$$\text{+}X^1\text{-}(J^1\text{—}X^2)_p(J^2\text{—}X^3)_q\text{-}(J^3)_r\text{+}_s$$

wherein $J^1$, $J^2$ and $J^3$, which may be the same or different, each includes —CO—, —$SO_2$—, —CON($R^5$)— (wherein $R^5$ represents a hydrogen atom, an alkyl group (from 1 to 6 carbon atoms) or a substituted alkyl group (from 1 to 6 carbon atoms)), —$SO_2$N($R^5$)— (wherein $R^5$ is as defined above), —N($R^5$)—$R^6$— (wherein $R^5$ is as defined above, and $R^6$ is an alkylene group having from 1 to about 4 carbon atoms), —N($R^5$)—$R^6$—N($R^7$)— (wherein $R^5$ and $R^6$ are as defined above, and $R^7$ is a hydrogen atom, an alkyl group (from 1 to 6 carbon atoms), a substituted alkyl group (from 1 to 6 carbon atoms), —O—, —S—, —N($R^5$)—CO—N($R^7$)— (wherein $R^5$ and $R^7$ are as defined above), —N($R^5$)—$SO_2$—N($R^7$)— (wherein $R^5$ and $R^7$ are as defined above), —COO—, —OCO—, —N($R^5$)$CO_2$— (wherein $R^5$ is as defined above) and —N($R^5$)CO— (wherein $R^5$ is as defined above). The substituents for the substituted alkyl group include, e.g., a halogen atom and an alkoxy group such as methoxy and ethoxy.

p, q, r and s each represents 0 or 1.

$X^1$, $X^2$ and $X^3$, which may be the same or different, each represents an unsubstituted or substituted alkylene group having from 1 to 10 carbon atoms, an aralkylene group or a phenylene group, and the alkylene group may be a straight chain or branched chain. Examples of the alkylene group include methylene, methylmethylene, dimethylmethylene, dimethylene, trimethylene, tetramethylene, pentamethylene, hexamethylene, decylmethylene and methoxyethylene, examples of the aralkylene group include benzylidene, and examples of the phenylene group include p-phenylene, m-phenylene, methylphenylene, methoxyphenylene and chlorophenylene.

X represents a monovalent group containing active methylene groups, and preferred examples thereof include $R_8$—CO—$CH_2$—COO—, NC—$CH_2$—COO—, $R^8$—CO—$CH_2$—CO— and $R^8$—CO—$CH_2$—CON($R^5$)— wherein $R^5$ is as defined above, and R8 represents a substituted or unsubstituted alkyl group having from 1 to 12 carbon atoms (for example, methyl, ethyl, n-propyl, n-butyl, t-butyl, n-nonyl, 2-methoxyethyl, 4-phenoxybutyl, benzyl and 2-methanesulfonamidoethyl), a substituted or unsubstituted aryl group (for example, phenyl, p-methylphenyl, p-methoxyphenyl and o-chlorophenyl), an alkoxy group (for example, methoxy, ethoxy, methoxyethoxy and n-butoxy), a cycloalkyloxy group (for example, cyclohexyloxy), an aryloxy group (for example, phenoxy, p-methylphenoxy, o-chlorophenoxy and p-cyanophenoxy), an amino group and a substituted amino group (for example, methylamino, ethylamino, dimethylamino and butylamino).

In the polymer represented by the general formula (1) of the present invention, examples of the ethylenically unsaturated monomer having active methylene groups represented by C are illustrated below, but the present invention is not limited thereto.

| | |
|---|---|
| M-1 | 2-Acetoacetoxyethyl methacrylate |
| M-2 | 2-Acetoacetoxyethyl acrylate |
| M-3 | 2-Acetoacetoxypropyl methacrylate |
| M-4 | 2-Acetoacetoxypropyl acrylate |
| M-5 | 2-Acetoacetoamidoethyl methacrylate |
| M-6 | 2-Acetoacetoamidoethyl acrylate |
| M-7 | 2-Cyanoacetoxyethyl methacrylate |
| M-8 | 2-Cyanoacetoxyethyl acrylate |
| M-9 | N-(2-Cyanoacetoxyethyl) acrylamide |
| M-10 | 2-Propionylacetoxyethyl acrylate |
| M-11 | N-(2-Propionylacetoxyethyl) methacrylamide |
| M-12 | N-4-(Acetoacetoxybenzyl)phenylacrylamide |
| M-13 | Ethylacryloyl acetate |
| M-14 | Acryloylmethyl acetate |
| M-15 | N-metharyloyloxymethyl acetoacetamide |
| M-16 | Ethylmethacryloylacetoacetate |
| M-17 | N-Allylcyano acetoamide |
| M-18 | Methylacryloyl acetoacetate |
| M-19 | N-(2-Methacryloyloxymethyl) cyanoacetamide |
| M-20 | p-(2-Acetoacetyl)ethylstyrene |
| M-21 | 4-Acetoacetyl-1-methacryloylpiperazine |
| M-22 | Ethyl-α-acetoacetoxy methacrylate |
| M-23 | N-Butyl-N-acryloxyloxyethyl acetoacetamide |
| M-24 | p-(2-Acetoacetoxy)ethylstyrene |

The ethylenically unsaturated monomer providing the repeating unit represented by A is a monomer whose homopolymer has a glass transition temperature of 35° C. or below, and examples thereof include alkyl acrylates (for example, methyl acrylate, ethyl acrylate, n-butyl acrylate, n-hexyl acrylate, benzyl acrylate, 2-ethylhexyl acrylate and n-dodecyl acrylate), alkyl methacrylates (for example, n-butyl methacrylate, n-hexyl methacrylate, 2-ethylhexyl methacrylate and n-dodecyl methacrylate), dienes (for example, butadiene and isoprene), vinyl esters (for example, vinyl acetate and vinyl propionate).

A monomer whose homopolymer has a glass transition temperature of 10° C. or below is more preferred, and particularly preferred examples of such monomers include alkyl acrylates having an alkyl side chain of 2 or more carbon atoms (for example, ethyl acrylate, n-butyl acrylate and 2-ethylhexyl acrylate), alkyl methacrylates having an alkyl side chain of 6 or more carbon atoms (for example, n-hexyl methacrylate and 2-ethylhexyl methacrylate), and dienes (for example, butadiene and isoprene).

The values of the glass transition temperature of the above-described polymers are described in J. Brandrup & E. H. Immergut co-edited, *Polymer Handbook,* 3rd. Ed. (John Wiley & Sons, 1989), Pages VI/209–VI/277.

The repeating unit represented by B represents a repeating unit other than A, i.e., a repeating unit derived from a monomer whose homopolymer has a glass transition temperature exceeding 35° C.

Specific examples thereof include acrylic acid esters (for example, t-butyl acrylate, phenyl acrylate and 2-naphthyl acrylate), methacrylic acid esters (for example, methyl methacrylate, ethyl methacrylate, 2-hydroxyethyl methacrylate, benzyl methacrylate, 2-hydroxypropyl methacrylate, phenyl methacrylate, cresyl methacrylate, 4-chlorobenzyl methacrylate and ethylene glycol dimethacrylate), vinyl esters (for example, vinyl benzoate and pivaloyloxyethylene), acrylamides (for example, acrylamide, methyl acrylamide, ethyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide and diacetone acrylamide), methacrylamides (for example, methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide and β-cyanoethyl methacrylamide), styrenes (for example, styrene, methylstyrene, dimethylstyrene, trimethylenestyrene, ethylstyrene, isopropylstyrene, chlorostyrene, methoxystyrene, acetoxystyrene, chlorostyrene, dichlorostyrene, bromostyrene and methyl vinylbenzoate), divinylbenzene, acrylonitrile, methacrylonitrile, N-vinylpyrrolidone, N-vinyloxazolidone, vinylidene chloride, and phenylvinyl ketone.

Also, in the polymer represented by the general formula (1) of the present invention, a monomer having an anionic functional group as disclosed in JP-B-60-15935, JP-B-45-3832, JP-B-53-28086 and U.S. Pat. No. 3,700,456 (for example, a carboxyl group and a sulfonic acid group) can be copolymerized for the purpose of improving the stability of the latex.

Such monomers include acrylic acid; methacrylic acid; itaconic acid; maleic acid; monoalkyl itaconate, for example, monomethyl itaconate and monoethyl itaconate; monoalkyl maleate, for example, monomethyl maleate and monoethyl maleate; citraconic acid; styrenesulfonic acid; vinylbenzylsulfonic acid; vinylsulfonic acid; acryloyloxyalkylsulfonic acid, for example, acryloyloxymethylsulfonic acid, acryloyloxyethylsulfonic acid and acryloyloxypropylsulfonic acid; methacryloyloxyalkylsulfonic acid, for example, methacryloyloxymethylsulfonic acid, methacryloyloxyethylsulfonic acid and methacryloyloxypropylsulfonic acid; acrylamidoalkylsulfonic acid, for example, 2-acrylamido-2-methylethanesulfonic acid, 2-acrylamido-2-methylpropanesulfonic acid and 2-acrylamido-2-methylbutanesulfonic acid; methacrylamindoalkylsulfonic acid, for example, 2-methacylamido-2-methylethanesulfonic acid, 2-methacrylamido- 2-methylpropanesulfonic acid and 2-methacrylamido- 2-methylbutanesulfonic acid. These acids may be alkali metal (for example, Na and K) salts or ammonium salts thereof.

x, y and z each represents a weight percent ratio of each of the monomer components in the polymer, and x is from 0.5 to 40, preferably from 0.5 to 30 and more preferably from 1 to 20, y is from 60 to 99.5, preferably from 70 to 99.5 and more preferably from 75 to 99, and z is from 0 to 50, preferably from 0 to 35 and more preferably from 0 to 25.

Also, the monomer having the above-described anionic functional group can be used, if desired, for providing the stability of latex, irrespective of the degree of the glass transition temperature of the homopolymer thereof, and the amount thereof, if used, is preferably from 0.5 to 20% by weight and particularly preferably from 1 to 10% by weight of the total weight of the polymers.

Preferred compounds for the polymer latex of the general formula (1) of the present invention are illustrated below. In the following compounds, the numeral in the parenthesis stands for a weight percent ratio of each of the components.

P-1 Ethyl acrylate/M-1/acrylic acid copolymer (85/10/5)

P-2 n-Butyl acrylate/M-1/sodium 2-acrylamido-2-methylpropanesulfonate copolymer (85/10/5)

P-3 n-Butyl acrylate/M-1/methacrylic acid copolymer (85/5/10)

P-4 2-Ethylhexyl acrylate/M-2/sodium 2-acrylamido-2-methylpropanesulfonate copolymer P-5 to 9 n-Butyl acrylate/M-1/acrylic acid copolymer (x/y/z)

P-5 x/y/z=95/2/3

P-6 x/y/z=92/5/3

P-7 x/y/z=89/8/3

P-8 x/y/z=81/16/3

P-9 x/y/z=72/25/3

P-10 n-Butyl acrylate/styrene/M-1/methacrylic acid copolymer (65/20/5/10)

P-11 Methyl acrylate/M-4/methacrylic acid copolymer (80/15/5)

P-12 n-Butyl acrylate/M-5/acrylic acid copolymer (85/10/5)

P-13 n-Butyl acrylate/M-7/methacrylic acid copolymer (85/10/5)

P-14 2-Ethylhexyl acrylate/M-9 copolymer (75/25)

P-15 n-Butyl acrylate/M-13/sodium styrenesulfonate copolymer (85/10/5)

P-16 n-Butyl acrylate/M-14/potassium styrenesulfinate copolymer (75/20/5)

P-17 n-Hexyl acrylate/methoxyethyl acrylate/M-2 copolymer (70/20/10)

P-18 2-Ethylhexyl acrylate/M-15/methacrylic acid copolymer (90/5/5)

P-19 n-Butyl acrylate/M-1/M-17/acrylic acid copolymer (75/5/15/5)

P-20 Octyl methacrylate/M-20/sodium styrenesulfonate copolymer (80/15/5)

The polymer latex of the present invention is prepared by an emulsion polymerization method which is well known in the art, and the particle size thereof is preferably in the range of from 0.01 to 1.0 μm. The emulsion polymerization can be preferably carried out by emulsifying the monomers using at least one emulsifying agent in water or a mixed solvent of water and an organic solvent miscible with water (for example, methanol, ethanol and acetone) and using a radical polymerization initiator, generally at a temperature of from 30° C. to about 100° C., preferably from 40° C. to about 90° C. The amount of the organic solvent miscible with water is from 0 to 100%, preferably from 0 to 50% by volume to water.

The polymerization reaction is generally carried out by using a radical polymerization initiator of from 0.05 to 5% by weight and, if necessary, an emulsifying agent of 0.1 to 10% by weight, based on the monomers to be polymerized. Examples of the polymerization initiator include azobis compounds, peroxides, hydroperoxides and redox solvents, for example, potassium persulfonate, ammonium persulfonate, tert-butyl peroctoate, benzoyl peroxide, isopropyl carbonate, 2,4-dichlorobenzyl peroxide, methyl ethyl ketone peroxide, cumene hydroperoxide, dicumyl peroxide, 2,2'-azobisisobutyrate, 2,2'-azobis( 2-amidinopropane) hydrochloride.

The emulsifying agents include anionic, cationic, amphoteric and nonionic surface active agents as well as water-soluble polymers. Examples of emulsifying agents include sodium laurate, sodium dodecylsulfonate, sodium 1-octoxycarbonylmethyl- 1-octoxycarbonylmethanesulfonate, sodium laurylnaphthalenesulfonate, sodium laurylbenzenesulfonate, sodium laurylphosphate, cetyltrimethyl ammonium chloride, dodecyltrimethylene ammonium chloride, N-2-ethylhexylpyridinium chloride, polyoxyethytenenonylphenyl ether, polyoxyethylenesorbitane lauryl ester, polyvinyl alcohol, and the emulsifying agents and the water-soluble polymers disclosed in JP-B-53-6190.

In the emulsion polymerization, the polymerization initiator, concentration, polymerization temperature, reaction time and the like can be varied broadly or easily.

Also, emulsion polymerization reaction may be carried out by previously charging the total amounts of the monomers, surface active agents and solvents into a vessel and feeding the initiator, or may be carried out while adding dropwise a part or whole of each of the components, if necessary.

With respect to types of the monomer having active methylene groups represented by C in the polymer represented by the general formula (1) of the present invention and the polymer latex thereof, and the synthesis method thereof, reference can be made to the above descriptions as well as the disclosures in U.S. Pat. Nos. 3,459,790, 3,619,195, 3,929,482 and 3,700,456, West German Patent 2,442,165, European Patent 13,147, JP-A-50-73625 and JP-A-50-146331.

Beck smoothness in the present invention can be easily determined by Japanese Industrial Standard (JIS) P8119, "Test Method for Smoothness of Paper and Paperboard by Beck Test Device" and TAPPI Standard Method T479.

Beck smoothness of at least one of surfaces or, preferably, both surfaces of the outermost layers on the emulsion layer side and on the opposite side in the light-sensitive material of the present invention is 4000 seconds or less, preferably from 10 seconds to 4000 seconds.

The Beck smoothness of the surface of the outermost layer on the emulsion layer side and the surface of the outermost layer on the opposite side to the emulsion layer can be controlled by changing an average particle diameter and an amount of the matting agent incorporated into the outermost layers on the both sides.

The average particle diameter of the matting agent in the present invention is preferably 20 μm or less, more preferably in the range of from 0.4 to 10 μm.

The amount of the matting agent added in the present invention is preferably in the range of from 5 to 400 mg/m$^2$, preferably in the range of from 10 to 200 mg/m$^2$.

The matting agent used in the present invention may be any solid particles as long as they do not adversely affect photographic characteristics. Inorganic matting agents include silicon dioxide, titanium and aluminum oxides, zinc and calcium carbonates, barium and calcium sulfates, calcium and aluminum silicates, and organic matting agents include cellulose esters, organic polymer matting agents such as polymethyl methacrylate, polystyrene or polydivinylbenzene, and copolymers thereof.

In the present invention, it is preferred to use a porous matting agent described in JP-A-3-109542, page 2, lower left column, line 8 to page 3, upper right column, line 4, a matting agent in which the surface thereof has been modified with an alkali described in JP-A-4-127142, page 3, upper right column, line 7 to page 5, lower right column, line 4, or a matting agent of an organic polymer described in Paragraph Nos. [0005] to [0026] of JP-A-6-118542.

Further, two or more kinds of these matting agents may be used in combination. For example, a combination of an inorganic matting agent and an organic matting agent, a combination of a porous matting agent and a non-porous matting agent, a combination of indefinite shape matting agent and a globular matting agent, a combination of matting agents having different average particle diameters (for example, a combination of a matting agent having an average particle diameter of 1.5 μm or more and a matting agent having an average particle diameter of 1 μm or less as described in JP-A- 6-118542) can be used.

The layer having a surface resistivity of $10^{12}$ Ω or less under the atmosphere of 25° C. and 30% RH in the present invention (hereinafter, the layer is referred to as "an electroconductive layer") can be obtained by using an electroconductive metal oxide or an electroconductive polymer compound as an electroconductive material.

A preferred electroconductive metal oxide which can be used in the present invention is a crystalline metal oxide particle, and, generally, the metal oxide containing oxygen defect and the metal oxide containing a small amount of hetero atoms which form a donor to the metal oxide used is preferred in view of their high electroconductivity, and, among others, the latter is particularly preferred since it does not give fog to the silver halide emulsion. Preferred examples of metal oxides include ZnO, $TiO_2$, $SnO_2$, $Al_2O_3$, $In_2O_3$, $SiO_2$, MgO, BaO, $MoO_3$ and $V_2O_5$, or a composite oxide thereof, and particularly preferred metal oxides include ZnO, $TiO_2$ and $SnO_2$. As examples of those containing hereto atoms, an addition of Al and/or In to ZnO, an addition of Sb, Nb and/or a halogen atom to $SnO_2$, and an addition of Nb and/or Ta to $TiO_2$ are effective. The amount of the hetero atoms to be added is preferably in the range of from 0.01 mol % to 30 mol %, and more preferably from 0.1 mol % to 10 mol %.

The metal oxide particles used in the present invention have an electroconductivity, and a volume resistivity thereof is preferably $10^7$ Ω-cm or less, in particular, $10^5$ Ω-cm or less.

These oxides are disclosed in, for example, JP-A-56-143431, JP-A-56-120519 and JP-A-58-62647.

Furthermore, as disclosed in JP-B-59-6235, an electroconductive material in which the above-described metal oxide is adhered to other crystalline metal oxide particles or fibrous materials (for example, titanium oxide) may be used.

The particle size which can be used is preferably 10 μm or less, and a size of 2 μm or less provides a good stability and is ease for use. Further, in order to minimize light scattering as low as possible, the use of electroconductive particles having a particle size of 0.5 μm or less is particularly preferred since a transparent light-sensitive material can be formed by using such particles.

Also, in the case of needle-like or fibrous electroconductive materials, those having a length of 30 μm or less and a diameter of 2 μm or less is preferred, and in particular, those having a length of 25 μm or less, a diameter of 0.5 μm or less, and a length/diameter ratio of 3 or more is preferred.

Preferred examples of electroconductive polymer compounds used in the present invention include polyvinylbenzenesulfonates, polyvinylbenzyltrimethyl ammonium chloride, quaternary polymers disclosed in U.S. Pat. Nos. 4,108,802, 4,118,231, 4,126,467 and 4,137,217, and polymer latexes disclosed in U.S. Pat. No. 4,070,189, German OLS 2,830,767, JP-A-61-296352 and JP-A-61-62033.

Specific examples of the electroconductive polymer compounds of the present invention are illustrated below, but the present invention is not limited thereto.

In these compounds, the composition of polymer is shown in percent by weight.

E-1

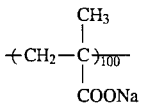

E-2

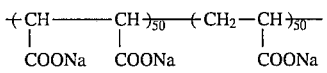

-continued

E-3

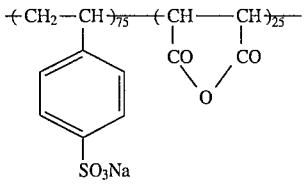

E-4

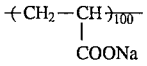

E-5

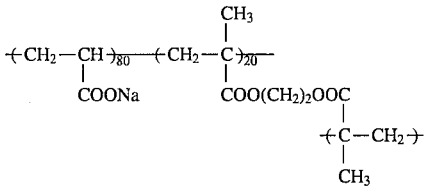

E-6

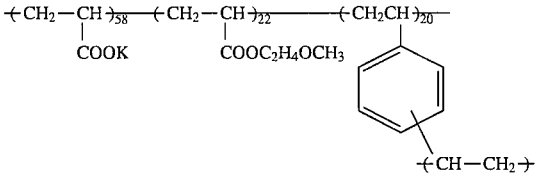

E-7

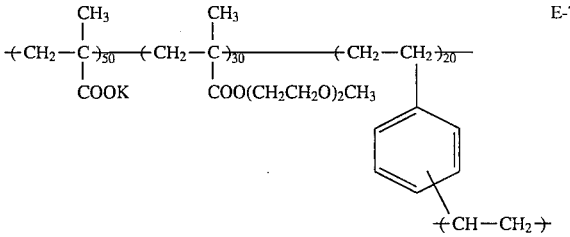

The electroconductive metal oxide or the electroconductive polymer compound of the present invention is used by dispersing or dissolving it in a binder.

The binder which can be used is not particularly limited as long as it has a film-forming ability, and examples thereof include proteins such as gelatin and casein, cellulose compounds such as carboxymethyl cellulose, hydroxyethyl cellulose, acetyl cellulose, diacetyl cellulose and triacetyl cellulose, saccharides such as dextran, agar, sodium alginate and starch derivatives, and synthetic polymers such as polyvinyl alcohol, polyvinyl acetate, polyacrylates, polymethacrylate, polystyrene, polyacrylamide, poly-N-vinylpyrrolidone, polyesters, polyvinyl chloride and polyacrylic acid.

In particular, gelatin (e.g., lime-treated gelatin, acid-treated gelatin, enzyme decomposed-gelatin, phthalated gelatin and acetylated gelatin), acetyl cellulose, diacetyl cellulose, triacetyl cellulose, polyvinyl acetate, polyvinyl alcohol, polybutyl acrylate, polyacrylamide and dextran are preferred.

In order to reduce the resistance of the electroconductive layer by effectively using the electroconductive metal oxide or the electroconductive polymer compound of the present invention, the volume content in the electroconductive material in the electroconductive layer is preferably as high as possible. However, since at least about 5% of a binder is required for obtaining a sufficient strength of the layer, the volume content of the electroconductive metal oxide or the electroconductive polymer compound is preferably in the range of from 5 to 95%.

The amount of the electroconductive metal oxide or the electroconductive polymer compound to be used in the present invention is preferably from 0.05 to 20 g, and more preferably from 0.1 to 10 g, per square meter of the light-sensitive material. The surface resistivity of the electroconductive layer of the present invention is $10^{12}$ Ω or less, preferably $10^{11}$ Ω or less in an atmosphere of 25° C. and 30% RH. A good antistatic property can be obtained with these conditions.

At least one electroconductive layer containing the electroconductive metal oxide or the electroconductive polymer compound of the present invention is provided as a constituting layer of the light-sensitive material of the present invention. For example, it may be a surface protective layer, a backing layer, an interlayer or a subbing layer, and, if desired, two or more layers can be provided.

In the present invention, in addition to the above-described electroconductive material, a better antistatic property can be obtained by using a fluorine-containing surface active agent in combination.

Examples of preferred fluorine-containing surface active agents which can be used in the present invention include surface active agents having a fluoroalkyl group having 4 or more carbon atoms, an alkenyl group or an aryl group, and having, as an ionic group, an anionic group (sulfonic acid (salt), sulfuric acid (salt), carboxylic acid (salt), phosphoric acid (salt)), a cationic group (amine salt, ammonium salt, aromatic amine salt, sulfonium salt, phosphonium salt), a Detain group (carboxyamine salt, carboxy ammonium salt, a sulfoamine salt, sulfo ammonium salt, phospho ammonium salt), or a nonionic group (substituted or unsubstituted polyoxyalkylene group, polyglyceryl group or a sorbitan residual group).

These fluorine-containing surface active agents are described in, for example, JP-A-49-10722, British Patent No. 1,330,356, U.S. Pat. Nos. 4,335,201 and 4,347,308, British Patent No. 1,417,915, JP-A-55-149938, JP-A-58-196544, and British Patent No. 1,439,402.

Some specific examples of these agents are shown below.

$$C_8F_{17}SO_3K \qquad \text{F-1}$$

$$C_8F_{17}SO_2N(C_3H_7)-CH_2COOK \qquad \text{F-2}$$

$$C_8F_{17}SO_2N(C_4H_9)-(CH_2CH_2O)_4-(CH_2)_4-SO_3Na \qquad \text{F-3}$$

$$C_8F_{17}SO_2N(H)CH_2CH_2CH_2OCH_2CH_2-\overset{\oplus}{N}(CH_3)_2-CH_3\ CH_3-C_6H_4-SO_3^{\ominus} \qquad \text{F-4}$$

In the present invention, the layer to which a fluorine-containing surface active agent is added is not specifically limited as long as it is at least one of the layers of the light-sensitive material of the present invention, and may be, for example, a surface protective layer, an emulsion layer, an interlayer, a subbing layer and a backing layer. Of these layers, a preferred portion for addition is a surface protective layer which may be on either the emulsion layer side or the backing layer side, but the addition to both the surface protective layers is more preferred.

When the surface protective layer comprises two or more layers, the fluorine-containing surface active agent may be added to any layer, and, alternatively, the agent may be used as an overcoat.

The amount of the fluorine-containing surface active agent of the present invention is preferably from 0.0001 to 1 g, more preferably from 0.0002 to 0.25 g, and most preferably from 0.0003 to 0.1 g, per square meter of the light-sensitive material.

Also, two or more of the fluorine-containing surface active agents of the present invention may be used in admixture.

Various additives used for the light-sensitive material of the present invention are not limited and, for example, those described in the following places can be preferably used.

1) Silver Halide Emulsion and Method for Preparation Thereof

JP-A-2-97937, from page 20, lower right column, line 12 to page 21, lower left column, line 14; JP-A-2-12236, page 7, upper right column, line 19 to page 8, upper left column, line 12; JP-A-4-330430 and JP-A-5-11389.

2) Spectral Sensitizing Dye

JP-A-2-55349, from page 7, upper left column, line 8 to page 8, lower right column, line 8; JP-A-2-39042, from page 7, lower right column, line 8 to page 13, lower right column, line 5; JP-A-2-12236, from page 8, lower left column, line 13 to page 8, lower right column line 4; JP-A-2-103536, from page 16, lower right column, line 3 to page 17, lower left column, line 20; as well as JP-A-1-112235, JP-A-2-124560, JP-A-3-7928, JP-A-5-11389 and JP-A-4-330434.

3) Hydrazine Nucleating Agent

JP-A-2-12236, from page 2, upper right column, line 19 to page 7, upper right column, line 3; and General Formula (II) and Compound Examples II-1 to II-54 described in JP-A-3- 174143, from page 20, lower right column, line 1 to page 27, upper right column, line 20.

4) Nucleating Accelerator

General Formulas (II-m) to (II-p) and Compound Examples II-1 to II-22 described in JP-A-2-103536, from page 9, upper right column, line 13 to page 16, upper left column, line 10, and the compounds described in JP-A-1-179939.

5) Surface Active Agent

JP-A-2-12236, from page 9, upper right column, line 7 to page 9, lower right column, line 7.

6) Compound having Acid Group

JP-A-2-103536, from page 18, lower right column, line 6 to page 19, upper left column, line 1, and JP-A-2-55349, from page 8, lower right column, line 13 to page 11, upper left column, line 8.

7) Anti-foggant

JP-A-2-103536, from page 17, lower right column, line 19 to page 18, upper right column, line 4, and page 18, lower right column lines 1 to 5, and the thiosulfinic acid compounds described in JP-A-1-237538.

8) Polyhydroxybenzenes

JP-A-2-55349, page 11, upper left column, line 9 to page 11, lower right column, line 17.

9) Slipping Agent and Plasticizer

JP-A-2-103536, from page 19, upper right column, line 6 to page 19, upper right column, line 15.

10) Film Hardening Agent

JP-A-2-103536, page 18, upper right column, lines 5 to 17.

11) Dye

Solid dyes described in JP-A-2-103536, from page 17, lower right column, lines 1 to 18, JP-A-2-39042, from page 4, upper right column, line 1 to page 6, upper right column, line 5, JP-A-2-294638 and JP-A-5-11382.

12) Tetrazolium Compound

JP-A-2-39143, from page 4, lower left column, line 8 to page 6, lower left column, line 6, and JP-A-3-123346, from page 3, upper right column, line 19 to page 5, upper left column, line 20.

13) Black Spots Preventing Agent

Compounds disclosed in U.S. Pat. No. 4,956,257 and JP-A-1- 11832

14) Redox Compound

Compounds represented by General Formula (I)(in particular, Compound Examples 1 to 50) of JP-A-2-301743;

General Formulae (R-1), (R-2) and (R-3), Compound Examples 1 to 75 disclosed in JP-A-3-174143, from pages 3 to 20; and the compounds disclosed in JP-A-5-257239 and JP-A-4-278939.

15) Monomethine Compound

Compounds of General Formula (II)(in particular, Compound Examples II-1 to II-26) of JP-A-2-287532.

16) Colloidal Silica

Compounds described in Paragraph No. [0005] of JP-A-4- 214551.

17) Developing Solution and Development Method

JP-A-2-1035356, from line 19, upper right column, line 16 to page 21, upper left column, line 8, and JP-A-2-55349, from page 13, lower right column, line 1 to page 16, upper left column, line 10.

The present invention is further illustrated in greater detail by the following examples, but the present invention is not limited thereto.

EXAMPLE 1

The styrene type polymer prepared in Preparation Example 1 was dried at 150° C. under reduced pressure, pelletized by a monoaxial extruder equipped with a vent, and the resulting pellets were crystallized while stirring in an air stream at 130° C. The content of a styrene monomer in the crystallized pellets was 1,100 ppm.

Then, the pellets were extruded from an extruder contained a filter and equipped with a T-die at the end of the extruder. The melt temperature at this point was 300° C.

The resulting sheet in a molten state was molded using an electrostatic adhesion method into a transparent sheet of 9% crystallinity having a thickness of 1400 μm.

The resulting sheet was stretched 3.5 times in a longitudinal direction at 110° C. and 4 times in a lateral direction at 120° C., and subjected to a heat treatment at 240° C. in a fixed strain state for 10 seconds and under 5% limited shrinkage for 20 seconds. The resulting film had a thickness of 100 μm and a haze of 1.0%.

The both surfaces of the resulting SPS support were subjected to a glow discharge treatment under the following conditions.

The four rod-shape electrodes in a cylindrical form having a cross-sectional diameter of 2 cm and a length of 150 cm and having a hollow portion which is a path of flow for a refrigerant carrier were fixed to an insulating plate at an interval of 10 cm. The resulting electrode plate was fixed in a vacuum tank, and the biaxially stretched film was passed at a distance of 15 cm from the electrode surface while facing to the electrode surface. The running speed of the film was controlled so as to effect the surface treatment for 2 seconds.

Just before the film passes on the front of the electrode zone, a heat-roll having a diameter of 50 cm equipped with a temperature controller is mounted so that the film contacts ¾ circumference of the heat-roll, and further the temperature of the film surface was controlled to 115° C. by contacting the film surface with a thermocouple thermometer between the heat-roll and the electrode zone.

The treatment was conducted at a pressure of 0.2 Torr in the vacuum tank, and a $H_2O$ partial pressure in the atmospheric gas of 75%. The discharge frequency was 30 KHz, the output was 2500 W, and the treatment strength was 0.5 KV.A. minute/$m^2$. Before winding the support after discharge treatment, the support was contacted with a cooling roll having a diameter of 50 cm equipped with a temperature controller so as to cool the surface temperature of the support to 30° C., and then the support was wound.

Then, the subbing layers having the following compositions were coated on the both surfaces of the support.

| Subbing Layer | Parts by Weight |
|---|---|
| Deionized alkali-treated gelatin (an isoelectric point, 5.0) | 10.0 |
| Water | 24.0 |
| Methanol | 961.0 |
| Salicylic acid | 3.0 |
| Polyamide-epichlorhydrin resin disclosed in Synthesis Example 1 of JP-A-51-3619 | 0.5 |
| Nonionic surface active agent, Compound I-13 disclosed in JP-B-3-27099 | 1.0 |

The above coating solution was coated in an amount of 10 ml/$m^2$ using a wire bar and, after drying at 115° C. for 2 minutes, the support was wound-up.

On one side of the resulting support were coated simultaneously a backing layer and a back-protective layer having the following compositions.

| Backing Layer | |
|---|---|
| Gelatin (Ca++ content, 3000 ppm) | Table 1 |
| Compound 1 | 3 mg/$m^2$ |
| Compound 2 | 40 mg/$m^2$ |
| Compound 3 | 40 mg/$m^2$ |
| Compound 4 | 80 mg/$m^2$ |
| Compound 5 | 150 mg/$m^2$ |
| Sodium dodecylbenzenesulfonate | 40 mg/$m^2$ |
| Sodium dihexyl-α-sulfosuccinate | 20 mg/$m^2$ |
| 1,2-Bis(vinylsulfonylacetamido)ethane | Table 1 |
| **Back-Protective Layer** | |
| Gelatin (Ca++ content, 3000 ppm) | 0.7 g/$m^2$ |
| Compound 1 | 3 mg/$m^2$ |
| Sodium dodecylbenzenesulfonate | 10 mg/$m^2$ |
| Sodium dihexyl-α-sulfosuccinate | 10 mg/$m^2$ |
| Sodium polystyrenesulfonate | 9 mg/$m^2$ |
| Compound 6 | 5 mg/$m^2$ |
| Polymethyl methacrylate fine particles (average particle diameter, 2.5 μm) | 30 mg/$m^2$ |
| Sodium sulfate | 60 mg/$m^2$ |

Compound 1

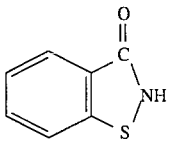

Compound 2

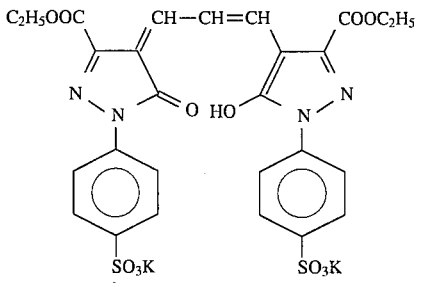

-continued

Compound 3

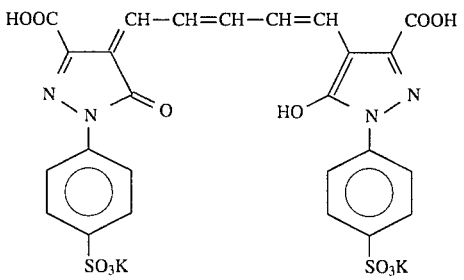

Compound 4

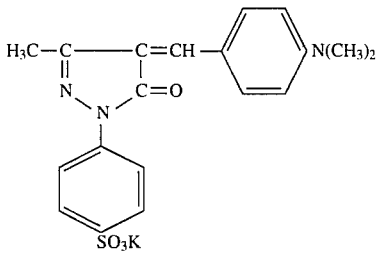

Compound 5

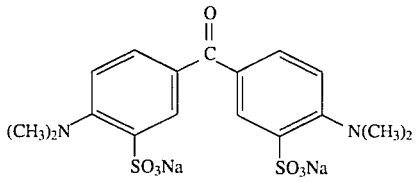

Compound 6

$C_8F_{17}SO_3Li$

Then, on the opposite surface were coated simultaneously 1st and 2nd layers of the emulsions, and lower and upper protective layers having the following compositions.

First Emulsion Layer

An aqueous solution of silver nitrate and an aqueous solution of sodium chloride containing $2\times10^{-5}$ mol of $(NH_4)_2Rh(H_2O)Cl_5$ per mol of silver were added simultaneously to an aqueous gelatin solution containing 4-hydroxy-6-methyl- 1,3,3a,7-tetraazaindene ($5\times10^{-3}$ mol per mol of silver) maintained at 40° C. over a period of 7 minutes while controlling the electric voltage at 95 mV to prepare core grains having a grain size of 0.12 μm. Thereafter, an aqueous solution of silver nitrate and an aqueous solution of sodium chloride containing $1.2\times10^{-4}$ mol of $(NH_4)_2Rh(H_2O)Cl_5$ per mol of silver were added simultaneously thereto over a period of 14 minutes while controlling the electric voltage at 95 mV to prepare silver chloride cubic grains having an average grain size of 0.15 μm.

To the resulting emulsion were added a solution containing a mixture of each $2.2\times10^{-5}$ mol/m$^2$ of the following hydrazine compounds (1) and (2) at a molar ratio of 1:1, 30 mg/m$^2$ of 4-hydroxy- 6-methyl-1,3,3a,7-tetraazaindene, 40 mg/m$^2$ and 10 mg/m$^2$ of each of the following Compound 7 and Compound 8, respectively, 1,1-bis(vinylsulfonyl)-methane as a film hardening agent as shown in Table 1, and the mixture was coated in an amount of 2.0 g/m$^2$ of silver and in a gelatin amount shown in Table 1.

Hydrazine compound (1)

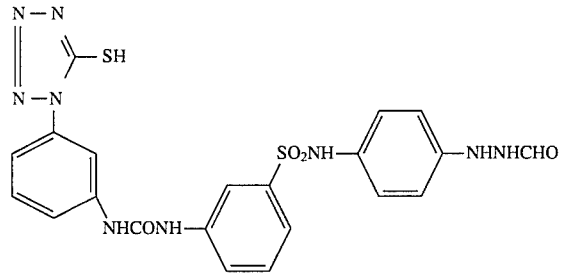

Hydrazine compound (2)

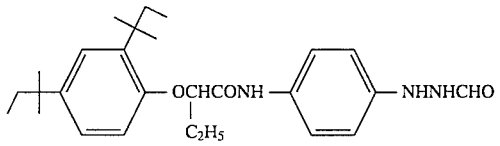

Compound 7

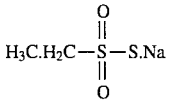

Compound 8

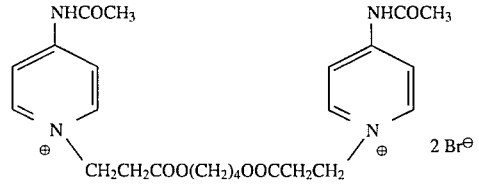

Second Emulsion Layer

An aqueous solution of silver nitrate and an aqueous solution of sodium chloride containing $4\times10^{-5}$ mol of $(NH_4)_2Rh(H_2O)Cl_5$ per mol of silver were added simultaneously to an aqueous gelatin solution containing 5,6-cyclopentane-4-hydroxy- 1,3,3a,7-tetraazaindene ($5\times10^{-3}$ mol per mol of silver) maintained at 40° C. over a period of 3.5 minutes while controlling the electric voltage at 95 mV to prepare core grains having a grain size of 0.08 μm. Thereafter, an aqueous solution of silver nitrate and an aqueous solution of sodium chloride containing $1.2\times10^{-4}$ mol of $(NH_4)_2Rh(H_2O)Cl_5$ per mol of silver were added simultaneously thereto over a period of 7 minutes while controlling the electric voltage at 95 mV to prepare silver chloride cubic grains having an average grain size of 0.10 μm.

An emulsion layer was coated in the same manner as the above-described first emulsion layer except for using the above emulsion layer in a silver amount of 1.5 g/m$^2$ and in a gelatin amount shown in Table 1.

| Lower Protective Layer | |
|---|---|
| Gelatin | Table 1 |
| 1-Hydroxy-2-benzaldoxime | 15 mg/m$^2$ |
| Compound 9 | 80 mg/m$^2$ |
| Compound 10 | 10 mg/m$^2$ |
| Upper Protective Layer | |
| Gelatin | Table 1 |
| Indefinite shape matting agent ($SiO_2$, | 30 mg/m$^2$ |

-continued

| | |
|---|---|
| an average grain diameter, 2.4 μm) | |
| Liquid paraffin (a gelatin dispersion) | 50 mg/m$^2$ |
| N-perfluorooctanesulfonyl-N-propyl-glycine potassium | 5 mg/m$^2$ |
| Sodium dodecylbenzenesulfonate | 10 mg/m$^2$ |
| Solid Dispersed Dye A* | 80 mg/m$^2$ |
| Solid Dispersed Dye B* | 40 mg/m$^2$ |

*Preparation of Fine Particle Dispersions of Solid Dispersed Dyes A and B

The preparation method in the present invention was in accordance with the method disclosed in JP-A-63-197943.

That is, water (434 ml) and a 6.7% solution of Triton X-200R surface active agent (53 g) (TX-200R, a product of Rohm & Haas Co.) were charged in a 1.5 liter bottle having a screw cap. Then, 20 g of the dye and beads (800 ml) of zirconium oxide ($ZrO_2$) (2 mm diameter) were added thereto, and, after closing the bottle cap tightly, the bottle was placed in a mill and the content thereof was ground for 4 days.

The content was added to a 12.5% aqueous gelatin solution (160 g) and placed in a roll mill for 10 minutes to reduce foams. The resulting mixture was filtered to remove $ZrO_2$ beads. Since the product had an average particle diameter of about 0.3 μm and still contained coarse particles, the product was separated by centrifugation to make the maximum particle size 1 μm or less.

Compound 9

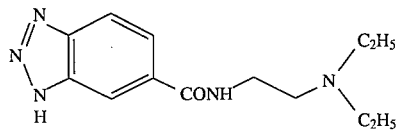

Compound 10

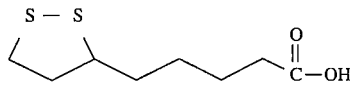

Solid Dispersed Dye A

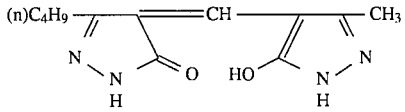

Solid Dispersed Dye B

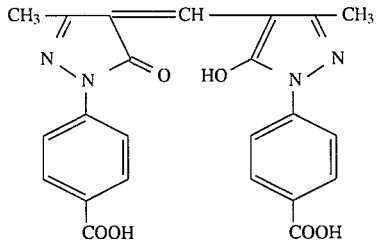

The resulting sample was evaluated for "register" by the following method.

Register

A negative original film having a printed-in grid pattern (a size of 26 cm×61 cm) and the sample were contacted using a pin bar in such a manner that the emulsion layers were contacted with each other, and exposed to light and developed to prepare a positive original film. Then, the same negative original film as used above and a commercially available contact film (Fuji Lith Contact Film KU-H100, a product of Fuji Photo Film Co., Ltd.) were contacted through a spacer (a polyethylene terephthalate film having a thickness of 100 μm) using the pin bar and then exposed.

Further, the above-described exposed KU-H100 film and the positive original film were contacted using the pin bar in such a manner that the back surfaces were contacted with each other and then exposed. Thereafter, KU-H100 film was subjected to the development treatment, and the deviation in the width in the grid pattern was measured. The lower the deviation, the better the register.

The above evaluation were conducted under the following conditions.

Printer: P-627FM (a product of Dainippon Screen Co., Ltd.)

Automatic Developing Machine: FG-680AG (a product of Fuji Photo Film Co., Ltd.)

Processing Conditions:

Developing Solution: The following Developing Solution (I), 38° C. for 20 seconds Fixing Solution: The following Fixing Solution (I)

Drying Temperature: 50° C.

Ambient Conditions: at 25° C. and 30% RH

The original film, the sample film and KU-H100 were used after seasoning at 25° C. and 30% RH for 3 hours or more.

The compositions of Developing Solution (I) and Fixing Solution (I) were shown below.

| Developing Solution (I) | |
|---|---|
| Potassium hydroxide | 90.0 g |
| Sodium hydroxide | 8.0 g |
| Disodium ethylenediamine tetraacetate | 1.0 g |
| Boric acid | 24.0 g |
| Sodium metabisulfite | 65.0 g |
| Potassium bromide | 10.0 g |
| Hydroquinone | 55.0 g |
| 5-Methylbenzotriazole | 0.40 g |
| N-Methyl-p-aminophenol | 0.50 g |
| Sodium 2-mercaptobenzimidazole-5-sulfonate | 0.30 g |
| Sodium 3-(5-mercaptotetrazole)benzenesulfonate | 0.20 g |
| N-n-Butyl-diethanolamine | 14.0 g |
| N,N-Dimethylamino-6-hexanol | 0.20 g |
| Sodium toluenesulfonate | 8.0 g |
| 5-Sulfosalicylic acid | 23.0 g |
| Water to make | 1 liter |
| pH (adjusted with potassium hydroxide) | 11.9 |
| Replenishing amount | 240 ml/m$^2$ |
| **Hardening and Fixing Solution (I)** | |
| Ammonium thiosulfate | 359.1 g |
| Disodium ethylenediamine tetraacetate | 2.26 g |
| Sodium thiosulfate pentahydrate | 32.8 g |
| Sodium sulfide | 64.8 g |
| NaOH (pure content) | 37.2 g |
| Glacial acetic acid | 87.3 g |
| Tartaric acid | 8.76 g |
| Sodium gluconate | 6.6 g |
| Aluminum sulfate | 25.3 g |
| Water to make | 3 liter |
| pH (adjusted with sulfuric acid or sodium hydroxide) | 4.85 |

The results obtained are shown in Table 1 below. As is apparent from Table 1, the sample having 6 g/m$^2$ of the total gelatin amount in the total hydrophilic colloid layers according to the present invention has a markedly improved register.

TABLE 1

| Sample No. | Amount of Hardening Agent ($mg/m^2$) Backing Layer | 1st Emulsion Layer | 2nd Emulsion Layer |
|---|---|---|---|
| 1 | 202 | 59 | 59 |
| | 177 | 52 | 52 |
| 3 (Invention) | 151 | 45 | 45 |
| 4 (Invention) | 125 | 38 | 38 |
| 5 (Invention) | 99 | 30 | 30 |
| 6 (Invention) | 73 | 23 | 23 |

| Sample No. | Amount of Gelatin ($g/m^2$) Backing Layer | Back-Protective Layer | 1st Emulsion Layer | 2nd Emulsion Layer |
|---|---|---|---|---|
| 1 | 3.20 | 0.70 | 1.40 | 1.20 |
| 2 | 2.70 | 0.70 | 1.15 | 0.95 |
| 3 (invention) | 2.20 | 0.70 | 0.90 | 0.70 |
| 4 (Invention) | 1.70 | 0.70 | 0.90 | 0.70 |
| 5 (Invention) | 1.20 | 0.70 | 0.90 | 0.70 |
| 6 (Invention) | 0.7 | 0.70 | 0.6 | 0.5 |

| Sample No. | Amount of Gelatin ($g/m^2$) Lower Protective Layer | Upper Protective Layer | Total in Whole Layers | Register (μm/61 cm Base Length) |
|---|---|---|---|---|
| 1 | 0.55 | 0.95 | 8.00 | 92 |
| 2 | 0.55 | 0.95 | 7.00 | 90 |
| 3 (Invention) | 0.55 | 0.95 | 6.00 | 50 |
| 4 (Invention) | 0.50 | 0.50 | 5.00 | 45 |
| 5 (Invention) | 0.25 | 0.25 | 4.00 | 42 |
| 6 (Invention) | 0.25 | 0.25 | 3.00 | 40 |

EXAMPLE 2

Samples were prepared in the same manner as described in Example 1, except for adding a polymer latex as shown in Table 2 to the backing layer, the emulsion layer, the first and second layers and the lower protective layer of Sample Nos. 3 to 5. The resulting sample was evaluated for "register" in the same manner as in Example 1 and also evaluated for "wet-scratch strength" by the following method.

Wet-Scratch Strength

Sample was immersed in Development Solution (I) at 38° C. for 1 minute, and a sapphire needle having a radius of 0.4 mm was contacted under pressure with the film surface of the sample. The load of the needle was continuously changed while moving the needle at a rate of 10 mm/second, and the load (g) at which the film was ruptured was determined.

The results obtained are shown in Table 2 below. As is apparent from Table 2, the samples according to the present invention are further improved with respect to the register by adding the polymer latex, and further Sample Nos. 10 to 18 to which the polymer latex represented by formula (1) had been added were found to have a good register and a high wet film strength.

TABLE 2

| Sample No. | Sample No. in Example 1 | Polymer Latex Composition | Average Particle Diameter (nm) |
|---|---|---|---|
| 2 | 2 | — | — |
| 3 (Invention) | 3 | — | — |
| 4 (Invention) | 4 | — | — |
| 5 (Invention) | 5 | — | — |
| 7 (Invention) | 3 | K-1 R=$C_2H_5$ | 80 |
| 8 (Invention) | 4 | " | " |
| 9 (Invention) | 5 | " | " |
| 10 (Invention) | 3 | P-1 | 100 |
| 11 (Invention) | 4 | " | " |
| 12 (Invention) | 5 | " | " |
| 13 (Invention) | 3 | P-2 | 95 |
| 14 (Invention) | 4 | " | " |
| 15 (Invention) | 5 | " | " |
| 16 (Invention) | 3 | P-8 | 106 |
| 17 (Invention) | 4 | " | " |
| 18 (Invention) | 5 | " | " |

| Sample No. | Amount of Polymer Latex (wt %, to Gelatin) Backing Layer | 1st Emulsion Layer | 2nd Emulsion Layer | Lower Protective Layer |
|---|---|---|---|---|
| 2 | — | — | — | — |
| 3 (Invention) | — | — | — | — |
| 4 (Invention) | — | — | — | — |
| 5 (Invention) | — | — | — | — |
| 7 (Invention) | 20 | 60 | 60 | 50 |
| 8 (Invention) | 15 | 50 | 50 | 40 |
| 9 (Invention) | 10 | 40 | 40 | 40 |
| 10 (Invention) | 20 | 60 | 60 | 50 |
| 11 (Invention) | 15 | 50 | 50 | 40 |
| 12 (Invention) | 10 | 40 | 40 | 40 |
| 13 (Invention) | 20 | 60 | 60 | 50 |
| 14 (Invention) | 15 | 50 | 50 | 40 |
| 15 (Invention) | 10 | 40 | 40 | 40 |
| 16 (Invention) | 20 | 60 | 60 | 50 |
| 17 (Invention) | 15 | 50 | 50 | 40 |
| 18 (Invention) | 10 | 40 | 40 | 40 |

| Sample No. | Register (μm/61 cm Base Length) | Wet Scratch Strength (g)* |
|---|---|---|
| 2 | 90 | 200 |
| 3 (Invention) | 50 | 200 |
| 4 (Invention) | 45 | 200 |
| 5 (Invention) | 42 | 200 |
| 7 (Invention) | 21 | 110 |
| 8 (Invention) | 20 | 108 |
| 9 (Invention) | 16 | 105 |
| 10 (Invention) | 22 | 200 |
| 11 (Invention) | 18 | 200 |
| 12 (Invention) | 15 | 200 |
| 13 (Invention) | 21 | 200 |
| 14 (Invention) | 17 | 200 |
| 15 (Invention) | 16 | 200 |
| 16 (Invention) | 20 | 200 |
| 17 (Invention) | 17 | 200 |
| 18 (Invention) | 15 | 200 |

*Values of wet scratch strength were determined on the surface having emulsion layers.

EXAMPLE 3

Samples were prepared in the same manner as described in Example 1, except for adding matting agents shown in Table 3 below (wherein PMM means polymethyl methacrylate) were added to the upper protective layer and the back-protective layer of Sample Nos. 2 and 4 of Example 1 and Sample Nos. 8 and 17 of Example 2 so as to give the Beck smoothness as shown in Table 3. The resulting samples were evaluated for the "register" in the same manner as described in Example 1. The Beck smoothness was determined in an atmosphere of 25° C. and 50% RH using Ohken type smoothness test device (a product of Asahi Seiko Co., Ltd.).

The results obtained are shown in Table 3. As is apparent from Table 3, Sample Nos. 21 to 25 according to the present invention show a further improved register by adjusting the Beck smoothness to 4000 seconds or less.

TABLE 3

| Sample No. | Sample No. in Examples 1 and 2 | Matting Agent (a: Upper Protective Layer, b: Back-Protective Layer) Composition | Average Particle Diameter (μm) | Amount Added (mg/m²) |
|---|---|---|---|---|
| 2 | 2 of Ex. 1 | a: $SiO_2$ | 2.5 | 20 |
| | | b: PMM | 2.5 | 20 |
| 19 | " | a: $SiO_2$ | 2.0 | 30 |
| | | b: PMM | 2.5 | 50 |
| 20 | " | a: $SiO_2$ | 2.5 | 60 |
| | | b: PMM | 3.5 | 10 |
| 4 (Invention) | 4 of Ex. 1 | a: $SiO_2$ | 2.4 | 30 |
| | | b: PMM | 2.5 | 30 |
| 21 (Invention) | " | a: $SiO_2$ | 2.0 | 30 |
| | | b: PMM | 2.5 | 50 |
| 22 (Invention) | " | a: $SiO_2$ | 2.5 | 60 |
| | | b: PMM | 3.5 | 10 |
| 23 (Invention) | " | a: $SiO_2$ | 3.5 | 30 |
| | | b: $SiO_2$ | 3.5 | 30 |
| 24 (Invention) | 8 of Ex.2 | a: PMM | 3.0 | 30 |
| | | b: PMM | 3.5 | 30 |
| 25 (Invention) | 17 of Ex. 2 | a: $SiO_2$ | 3.0 | 30 |
| | | b: PMM | 4.7 | 10 |

| Sample No. | Beck Smoothness (sec) Emulsion Side | Back Side | Register (μm/61 cm Base Length) |
|---|---|---|---|
| 2 | 4300 | 4400 | 90 |
| 19 | 3000 | 3500 | 80 |
| 20 | 1700 | 1600 | 76 |
| 4 | 4200 | 4300 | 45 |
| 21 | 2800 | 3200 | 25 |
| 22 | 1600 | 1500 | 20 |
| 23 | 700 | 600 | 17 |
| 24 | 900 | 500 | 15 |
| 25 | 600 | 300 | 14 |

EXAMPLE 4

Samples were prepared in the same manner as described in Example 1, except for providing an electroconductive layer having the following composition between the backing layer and the subbing layer of Sample Nos. 2 to 6 of Example 1 and Sample Nos. 24 and 25 of Example 3. The resulting samples were evaluated for the "register" in the same manner as described in Example 1, The surface resistivity of the electroconductive layer was determined by allowing the sample to stand at 25° C. and 30% RH for 12 hours, putting the sample between the electrodes made by brass (using a stainless steel in the portion where the electrodes contact with the sample) having an electrode gap of 0.14 cm and a length of 10 cm, and the surface resistivity after one minute was measured using an electrometer TR 8651 produced by Takeda Riken Co., Ltd.

The results obtained are shown in Table 4 below. As is apparent from Table 4, Sample Nos. 27 to 32 according to the present invention show a further improved "register" by providing an electroconductive layer having a surface resistivity of $10^{12}$ Ω or less.

| Electroconductive Layer | |
|---|---|
| $SnO_2$/Sb (9/1 weight ratio, average particle diameter, 0.25 μm) | 200 mg/m² |
| Gelatin (Ca++ content, 3000 ppm) | 77 mg/m² |
| Compound 11 | 7 mg/m² |
| Sodium dodecylbenzenesulfonate | 10 mg/m² |
| Sodium dihexyl-α-sulfosuccinate | 40 mg/m² |
| Sodium polystyrenesulfonate | 9 mg/m² |

Compound 11

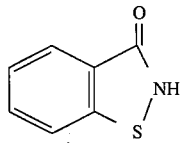

TABLE 4

| Sample No. | Sample No. of Examples 1 and 3 | Electro-conductive Layer* | Register (μm/61 cm Base Length) |
|---|---|---|---|
| 2 | 2 of Ex. 1 | None | 90 |
| 3 (Invention) | 3 of Ex. 1 | None | 50 |
| 4 (Invention) | 4 of Ex. 1 | None | 45 |
| 5 (Invention) | 5 of Ex. 1 | None | 42 |
| 6 (Invention) | 6 of Ex. 1 | None | 40 |
| 24 (Invention) | 24 of Ex. 3 | None | 15 |
| 25 (Invention) | 25 of Ex. 3 | None | 14 |
| 26 (Invention) | 2 of Ex. 1 | Present | 72 |
| 27 (Invention) | 3 of Ex. 1 | Present | 30 |
| 28 (Invention) | 4 of Ex. 1 | Present | 25 |
| 29 (Invention) | 5 of Ex. 1 | Present | 20 |
| 30 (Invention) | 6 of Ex. 1 | Present | 19 |
| 31 (Invention) | 24 of Ex. 3 | Present | 12 |
| 32 (Invention) | 25 of Ex. 3 | Present | 10 |

*Surface resistivity of the electroconductive layer (at 25° C. and 30% RH)
Before development processing: $6.3 \times 10^9$ Ω
After development processing: $1.6 \times 10^{10}$ Ω (processed in unexposed state)

EXAMPLE 5

The procedure described in Example 1 was followed except for using the polymer of Preparation Example 2, adjusting the thickness of the sheet as a preparatory molded material to 1050 μm, and changing the lateral stretching ratio to 3 times and adjusting the limited shrinkage to 5%. The resulting film had a thickness of 100 μm and a haze of 0.8%.

Both surfaces of the resulting SPS support was subjected to the surface treatment with the glow discharge and then a subbing layer was coated in the same manner as in Example 1.

Then, an electroconductive layer and a backing layer having the following compositions were coated on one side of the resulting support.

| Electroconductive Layer | |
|---|---|
| $SnO_2$/Sb (9/1 weight ratio, average particle diameter, 0.25 μm) | 200 mg/m² |
| Gelatin (Ca++ content, 3000 ppm) | 77 mg/m² |
| Compound-11 | 7 mg/m² |
| Sodium dodecylbenzenesulfonate | 10 mg/m² |
| Sodium dihexyl-α-sulfosuccinate | 40 mg/m² |
| Sodium polystyrenesulfonate | 9 mg/m² |

-continued

| Backing Layer | |
|---|---|
| Gelatin (Ca++ content, 3000 ppm) | 2.82 g/m$^2$ |
| Compound 11 | 3 mg/m$^2$ |
| Polymethyl methacrylate fine particles (average particle diameter, 3.4 μm) | 50 mg/m$^2$ |
| Compound 12 | 40 mg/m$^2$ |
| Compound 13 | 40 mg/m$^2$ |
| Compound 14 | 80 mg/m$^2$ |
| Sodium dodecylbenzenesulfonate | 75 mg/m$^2$ |
| Sodium dihexyl-α-sulfosuccinate | 20 mg/m$^2$ |
| Compound 15 | 5 mg/m$^2$ |
| N-Perfluorooctanesulfonyl-N-propylglycine potassium | 7 mg/m$^2$ |
| Sodium sulfate | 50 mg/m$^2$ |
| Sodium acetate | 85 mg/m$^2$ |
| 1,2-Bis(vinylsulfonylacetamido)ethane | 150 mg/m$^2$ |

Compound 11

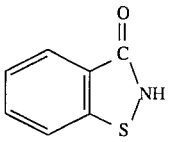

Compound 12

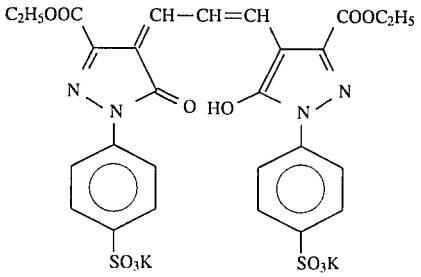

Compound 13

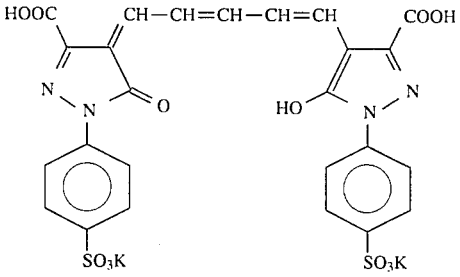

Compound 14

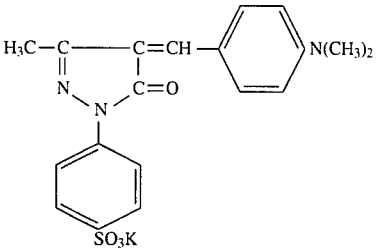

Compound 15

$C_8F_{17}SO_3Li$

Then, an emulsion layer, a lower protective layer and an upper protective layer having the following compositions were coated simultaneously on the opposite side of the support.

| Emulsion Layer | |
|---|---|
| Preparation of Emulsion | |
| Solution I | |
| Water | 1000 ml |
| Gelatin | 20 g |
| Sodium chloride | 20 g |
| Sodium 1,3-dimethylimidazolidine-2-thione | 20 g |
| Sodium benzenesulfonate | 6 mg |
| Solution II | |
| Water | 400 ml |
| Silver nitrate | 100 g |
| Solution III | |
| Water | 400 ml |
| Sodium chloride | 30.5 g |
| Potassium bromide | 14 g |
| Potassium hexachloroiridate (III) (0.001% aqueous solution) | 15 ml |
| Ammonium hexabromorhodium (III) acid (0.001% aqueous solution) | 1.5 ml |

Solution II and Solution III were added simultaneously to Solution I maintained at 38° C. and a pH of 4.5 while stirring over a period of 10 minutes to form fine grains of 0.16 μm. Subsequently, the following Solution IV and Solution V were added thereto over a period of 10 minutes. Further, 0.15 g of potassium iodide was added thereto to complete the grain formation.

| Solution IV | |
|---|---|
| Water | 400 ml |
| Silver nitrate | 100 g |
| Solution V | |
| Water | 400 ml |
| Sodium chloride | 30.5 g |
| Potassium bromide | 14 g |
| $K_4Fe(CN)_6$ | $1 \times 10^{-5}$ mol/mol of Ag |

Thereafter, the resulting emulsion was washed with water by the conventional flocculation method, and 40 g of gelatin was added thereto.

The emulsion was adjusted to a pH of 5.3 and a pAg of 7.5, 5.2 mg of sodium thiosulfate, 10.0 mg of chloroauric acid and 2.0 mg of N,N-dimethylselenourea were added, then, 8 mg of sodium benzenesulfonate and 2.0 mg of sodium benzenesulfinate were added thereto, and the emulsion was chemically sensitized to the optimum sensitization at 55° C. to prepare finally an emulsion of silver iodochlorobromide cubic grains having an average grain diameter of 0.20 μm, and a silver chloride content of 80 mol %.

Then, Sensitizing Dye (1) was added thereto in an amount of $5\times10^{-4}$ mol/mol of Ag to effect ortho sensitization. Further, hydroquinone and 1-phenyl-5-mercaptotetrazole as anti-foggants were added thereto in amounts of 2.5 g and 50 mg per mol of Ag, respectively, and colloidal silica (Snowtex C, a product of Nissan Chemical Industries, Ltd., an average particle diameter of 0.015 μm) in an amount of 30% by weight to gelatin, the polymer latex Compound P-8 (an average particle diameter of 0.1 μm) as a plasticizer in an amount of 40% by weight to gelatin, and 100 mg/m$^2$ of 1,1'-bis(vinylsulfonyl)methane as a film hardening agent were added to the emulsion.

The resulting coating solution was coated so as to give the coating amounts of 3.3 g/m$^2$ of Ag and 1.5 g/m$^2$ of gelatin.

Sensitizing Dye (1)

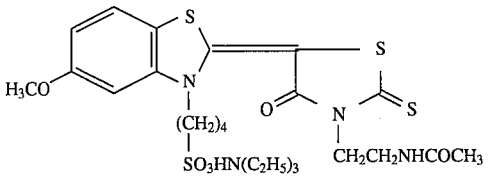

| Formulation of Lower Protective Layer | per m$^2$ |
|---|---|
| Gelatin | 0.5 g |
| Sodium benzenesulfonate | 4 mg |
| 1,5-Dihydroxy-2-benzaldoxime | 25 mg |
| Polymer latex Compound P-8 (average particle diameter, 0.1 μm) | 125 mg |
| **Formulation of Upper Protective Layer** | **per m$^2$** |
| Gelatin | 0.25 g |
| Polymethyl methacrylate fine particles (average particle diameter, 2.7 μm) | 40 mg |
| Compound 16 (gelatin dispersion of slip agent) | 30 mg |
| Colloidal silica (Snowtex C produced by Nissan Chemical Industries, Ltd.) | 30 mg |
| Compound 17 | 5 mg |
| Sodium dodecylbenzenesulfonate | 22 mg |

The coefficient of dynamic friction of the resulting sample was all 0.22±0.03 (at 25° C. and 60% RH, a diameter of sapphire needle=1 mm, a load of 100 g, and a speed of 60 cm/minute).

Compound 16

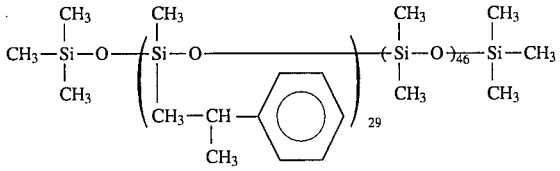

Compound 17

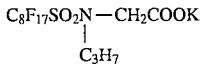

The thus-prepared sample was then coated and after 10 days, it was cut and processed under the conditions of 25° C. and 60% RH, and the exposure of a grid pattern was conducted consecutively from the first plate to the fourth plate using a direct scanner graph SG-757 (a product of Dainippon Screen Co., Ltd.) and thereafter subjected to the development processing using an automatic developing machine FG-680AS (a product of Fuji Photo Film Co., Ltd.). As a result of measurement on deviation in the width of the grid pattern, the deviation in the width was found to be 12 μm/61 cm base length or less, indicating a very good register.

In the above procedure, the ambient conditions used for the exposure and the development were 25° C. and 40% RH. The developing solution and the fixing solution used were SR-D1 and SR-F1 produced by Fuji Photo Film Co., Ltd., and developing condition was at 38° C. for 11 seconds.

EXAMPLE 6

The procedure described in Example 1 was followed, except that the thickness of the sheet as a preparatory molded material was adjusted to 1900 μm, the lateral stretching ratio was changed to 3 times and the limited shrinkage ratio was changed to 3%. The resulting film had a thickness of 180 μm and a haze of 1.5%.

Both surfaces of the resulting SPS support was subjected to the surface treatment with the glow discharge and then a subbing layer was coated in the same manner as in Example 1.

The resulting support was then coated on one surface thereof a light-insensitive layer, an emulsion layer and a protective layer having the following compositions simultaneously.

Light-Insensitive Layer

| | |
|---|---|
| Gelatin | 0.8 g/m$^2$ |
| Compound A | 2 mg/m$^2$ |
| Sodium polystyrenesulfonate | 15 mg/m$^2$ |
| 2,4-Dichloro-6-hydroxy-s-triazine | 7 mg/m$^2$ |
| 1,3-Bis(vinylsulfonyl)-propanol-2 | 15 mg/m$^2$ |
| Polymer latex Compound P-8 (particle diameter, 0.08 μm) | 600 mg/m$^2$ |

Compound A

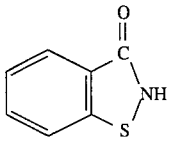

Emulsion Layer

A silver halide emulsion comprising 30 mol % silver bromide and 70% silver chloride and containing 3.5×10$^{-7}$ mol of rhodium per mol of Ag was prepared by the conventional method well known in the art, and, after removing soluble salts, gelatin was added thereto. Then, 6 mg of sodium thiosulfate and 8.5 mg of chloroauric acid per mol of Ag were added to the emulsion to effect a chemical sensitization at 60° C. for 50 minutes.

The resulting emulsion contained cubic grains having an average grain size of 0.25 μm and 125 g of Ag and 53 g of gelatin per kg of emulsion.

To the resulting emulsion were added 11 mg/m$^2$ of 1-(2-hydroxyethoxyethyl)- 3-(pyridin-2-yl)-5-[(3-sulfobutyl-5-chloro- 2-benzoxazolinidene)ethylidene]-2-thiohydantoin potassium salt as an ortho sensitizing dye, and further 7 mg/m$^2$ of α-lipoic acid, 27 mg/m$^2$ of hydroquinone, 3 mg/m$^2$ of Compound (1), 1 mg/m$^2$ of 1-phenyl-5-mercaptotetrazole, 1 mg/m$^2$ of Compound (2), 6 mg/m$^2$ of Compound (3), 4 mg/m$^2$ of Compound (4), 2 mg/m$^2$ of Compound (5), 8 mg/m$^2$ of 6-methyl-4-hydroxy- 1,3,3a,7-tetrazaindene as a stabilizing agent, and 40 mg/m$^2$ of 1,3-bis(vinylsulfonyl-)propanol-2 as a film hardening agent. In addition, 900 mg/m$^2$ of ethyl acrylate latex (an average particle size, 0.05 μm) and 40 mg/m$^2$ of sodium polystyrenesulfonate as a thickening agent were added thereto. The resulting coating solution was coated in a silver amount of 3.5 g/m$^2$ and a gelatin amount of 1.5 g/m$^2$.

Compound (1)

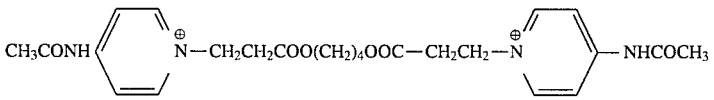

Compound (2)

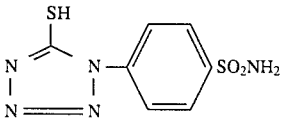

Compound (3)

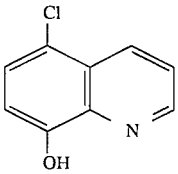

Compound (4)

$HO(CH_2CH_2O)_a(CH_2CH_2CH_2CH_2O)_b(CH_2CH_2O)_cH$
a + c = 30, b = 14

Compound (5)

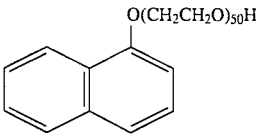

Protective Layer

| | |
|---|---|
| Gelatin | 0.7 g/m$^2$ |
| Polymethyl methacrylate fine particles (average particle diameter, 2.5 μm) | 40 mg/m$^2$ |
| Compound B | 50 mg/m$^2$ |
| Sodium dodecylbenzenesulfonate | 40 mg/m$^2$ |
| Sodium polystyrenesulfonate | 8 mg/m$^2$ |
| 2,4-Dichloro-6-hydroxy-s-triazine | 18 mg/m$^2$ |

Compound B

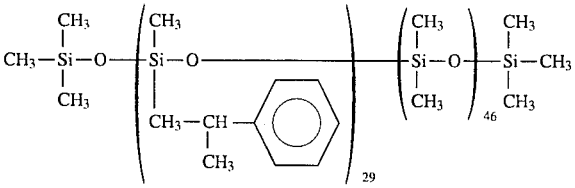

Then, the opposite side of the support was coated simultaneously with an electroconductive layer and a backing layer having the following compositions.

Electroconductive Layer

| | |
|---|---|
| Gelatin (Ca++ content, 3000 ppm) | 100 mg/m$^2$ |
| Compound A | 1 mg/m$^2$ |
| Sodium dihexyl-α-sulfosuccinate | 11 mg/m$^2$ |
| Sodium dodecylbenzenesulfonate | 15 mg/m$^2$ |
| Sodium polystyrenesulfonate | 10 mg/m$^2$ |

-continued

| | |
|---|---|
| $SnO_2$/Sb (9/1 weight ratio, average particle diameter, 0.25 μm) | 200 mg/m$^2$ |

Backing Layer

| | |
|---|---|
| Gelatin (Ca++ content, 30 ppm) | 1.5 g/m$^2$ |
| Polymethyl methacrylate fine particles (average particle diameter, 3.4 μm) | 20 mg/m$^2$ |
| Compound A | 4 mg/m$^2$ |
| Dye (1) | 60 mg/m$^2$ |
| Dye (2) | 40 mg/m$^2$ |
| Dye (3) | 32 mg/m$^2$ |

-continued

| | |
|---|---|
| Sodium dihexyl-α-sulfosuccinate | 20 mg/m$^2$ |
| Sodium dodecylbenzenesulfonate | 80 mg/m$^2$ |
| Acetic acid | 7 mg/m$^2$ |
| Sodium sulfate | 200 mg/m$^2$ |
| Compound C | 8 mg/m$^2$ |
| Compound D | 9 mg/m$^2$ |
| Sodium polystyrenesulfonate | 16 mg/m$^2$ |
| 1,3-Bis(vinylsulfonyl)-propanol-2 | 45 mg/m$^2$ |

Compound A

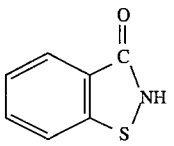

Dye (1)

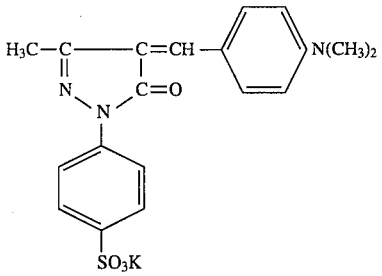

Dye (2)

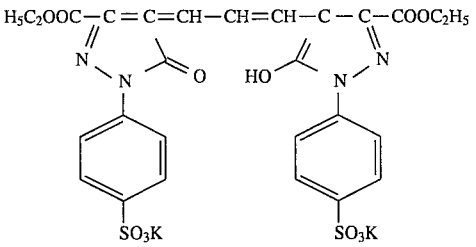

Dye (3)

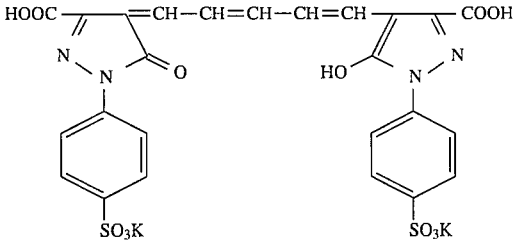

Compound C $C_8F_{17}SO_3Li$

Compound D

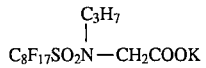

The resulting sample was cut and processed, and the exposure of a grid pattern was carried out consecutively from the 1st plate to the 4th plate using a laser photoplotter: Lastergraph RG-5000 (produced by Dainippon Screen Co., Ltd.). Then, the sample was subjected to the developing processing using an automatic developing machine, FG-660 (manufactured by Fuji Photo Film Co., Ltd.), and deviation in the width of the grid pattern was measured. As a result, the deviation in the width from the 1st to 4th plates were found to be 10 μm/61 cm base length or less, indicating a good register.

In the above procedure, ambient conditions for the exposure and the development were at 25° C. and 40% RH. The development and the fixing were carried out by using HS-5 and GR-F1 produced by Fuji Photo Film Co., Ltd., respectively, under the developing condition of 32° C. for 60 seconds and the drying temperature of 50° C.

EXAMPLE 7

The SPS support of Example 1 provided with subbing layers on both surfaces thereof was coated on one side thereof with a UL layer, an EM layer, a PC layer and an OC layer having the following compositions.

| UL Layer | |
|---|---|
| Gelatin | 0.5 g/m$^2$ |
| Polymer latex Compound P-8 | 0.15 g/m$^2$ |

EM Layer

Preparation of Emulsion

An aqueous solution of silver nitrate, and an aqueous solution of halides containing potassium bromide, sodium chloride, $K_3IrCl_6$ corresponding to $3.5\times10^{-7}$ mol per mol of silver and $K_2Rh(H_2O)Cl_5$ corresponding to $2.0\times10^{-7}$ mol per mol of silver were added to an aqueous gelatin solution containing sodium chloride and 1,3-dimethyl-2-imidazolidinethione by the double-jet method to prepare silver chlorobromide grains having an average grain size of 0.25 μm, and a silver chloride content of 70 mol %.

Then, the grains were washed with water according to the conventional flocculation method, 40 g of gelatin per mol of silver was added thereto, and, after further adding 7 mg of sodium benzenethiosulfonate and 2 mg of benzenesulfinic acid per mol of silver, the mixture was adjusted to a pH of 6.0 and a pAg of 7.5. Thereafter, 1 mg of a selenium sensitizing agent having the following structure, 1 mg of sodium thiosulfate and 4 mg of chloroauric acid per mol of silver were added thereto to effect the chemical sensitization to the maximum sensitivity at 60° C. Then, 150 mg of 4-hydroxy-6-methyl- 1,3,3a,7-tetrazaindene as a stabilizing agent and 100 mg of Compound A of Example 6 as a preservative. The resulting grains had an average grain size of 0.25 μm and was silver chlorobromide cubic grains having a silver chloride content of 70 mol %. (Coefficient of variation: 10%)

To the emulsion thus obtained were added $5\times10^{-4}$ mol of the following compound (S-1) and $5\times10^{-4}$ mol of the following compound (S-2) as sensitizing dyes per mol of silver, and further, $3\times10^{-4}$ mol of the following mercapto compound (a), $4\times10^{-4}$ mol of the following mercapto compound (b), $4\times10^{-4}$ mol of the following triazine compound (c), $2\times10^{-3}$ mol of 5-chloro- 8-hydroxyquinoline, $5\times10^{-4}$ mol of the surface active compound (W-1), and $4\times10^{-4}$ mol of the following compound (A- 1) as a nucleation accelerator per mol of silver were added thereto. Furthermore, 100 mg of hydroquinone, and N-oleyl-N-methyltaurine sodium salt in such an amount that the coating amount was 30 mg/m$^2$ were added thereto. Then, $5\times10^{-4}$ mol of the hydrazine derivative (H-1), 200 mg/m$^2$ of latex represented by the following (d), 400 mg/m$^2$ of the polymer latex Compound P-8, 200 mg/m$^2$ of colloidal silica having an average particle diameter of 0.02 μm, and further 240 mg/m$^2$ of 1,1'-bis(vinylsulfonyl)methane as a film hardening agent were added thereto. The pH value of the resulting solution was adjusted to 5.65 with acetic acid. The resulting solution was then coated in coating amounts of 3.5 g/m$^2$ of silver and 1.3 g/m$^2$ of gelatin.

PC Layer

To an aqueous gelatin solution were added 50 wt % of a dispersion of ethyl acrylate based on gelatin, and, based on coating amounts, 5 mg/m$^2$ of sodium ethylsulfonate and 10 mg/m$^2$ of 1,5-dihydroxy-2-benzaldoxime, and the resulting mixture was coated in a gelatin amount of 0.3 g/m$^2$.

Compound S-1

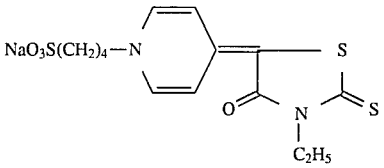

Compound S-2

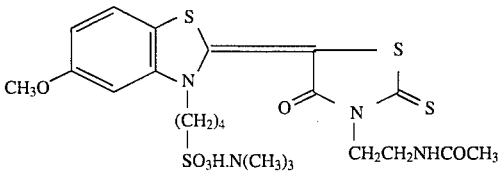

(a)

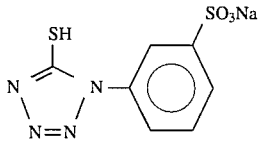

(b)

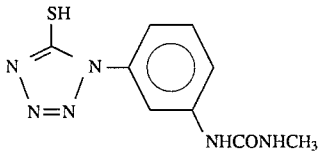

(c)

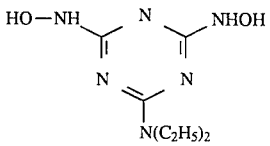

(A-1)

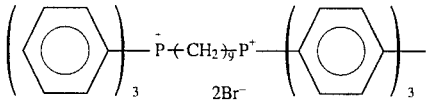

(W-1)

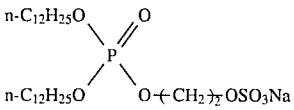

(H-1)

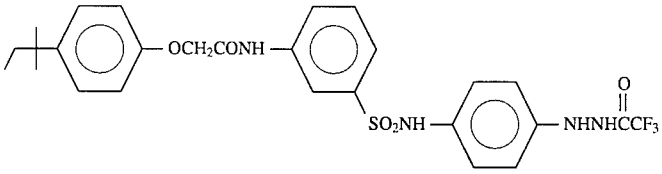

(d)

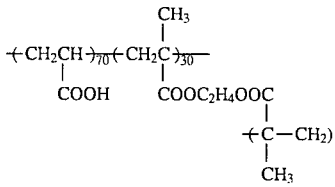

OC Layer 0.3 g/m$^2$ of gelatin, 40 mg/m$^2$ of indefinite shape $SiO_2$ matting agent having an average particle size of about 3.5 μm, 0.1 g/m$^2$ of methanol silica, 100 mg/m$^2$ of polyacrylamide and 20 mg/m$^2$ of silicone oil, and, as coating aids, 5 mg/m$^2$ of a fluorine-containing surface active agent represented by the following structure (e) and 100 mg/m$^2$ of sodium dodecylbenzenesulfonate were coated.

$$C_8F_{17}SO_2N(C_3H_7)CH_2COOK \quad \text{(e)}$$

Then, the opposite side of the support was coated with an electroconductive layer, a backing layer and a back-protective layer having the following compositions simultaneously.

| Electroconductive Layer | |
|---|---|
| $SnO_2$/Sb (9/1 weight ratio, average particle diameter, 0.25 μm) | 200 mg/m$^2$ |
| Gelatin ($Ca^{++}$ content, 3000 ppm) | 77 mg/m$^2$ |
| Compound A of Example 6 | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| **Formulation of Backing Layer** | |
| Gelatin | 2.4 g/m$^2$ |
| Surface active agent: Sodium p-dodecyl-benzenesulfonate | 40 mg/m$^2$ |
| Film hardening agent: 1,2-Bis(vinylsulfonylacetamido)ethane | 125 mg/m$^2$ |
| **Dyes: Mixture of Dye (a), Dye (b) and Dye (c)** | |
| Dye (a) | 70 mg/m$^2$ |
| Dye (b) | 70 mg/m$^2$ |
| Dye (c) | 90 mg/m$^2$ |

Dye (a)

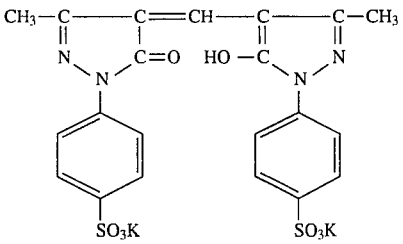

Dye (b)

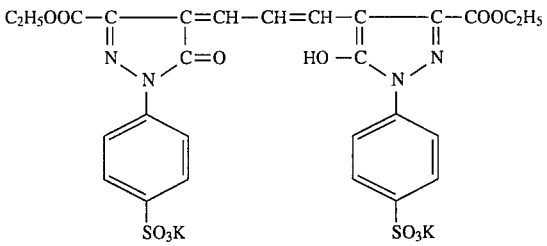

-continued

Dye (c)

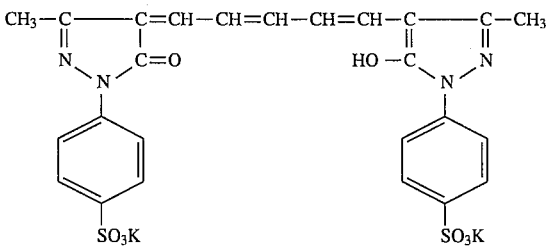

| Back-Protective Layer | |
|---|---|
| Gelatin | 0.8 g/m$^2$ |
| Polymethyl methacrylate fine particles (average particle diameter, 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

The resulting sample was cut and processed in the same manner as described in Example 5 and evaluated for the register in the same manner as in Example 5. As a result, the deviation in width from the 1st plate to the 4th plate was found to be 10 μm/61 cm base length or less, indicating a good register.

In the above procedure, Developing Solution (II) having the following composition was used for development and Fixing Solution (I) of Example 1 was used for fixing. The development processing was conducted using an automatic developing machine FG-680AS (produced by Fuji Photo Film Co., Ltd.) under developing conditions of 35° C. for 30 seconds and the drying temperature of 50° C.

| Developing Soltuion (II) | |
|---|---|
| Potassium hydroxide | 35.0 g |
| Diethylenetriamine pentaacetic acid | 2.0 g |
| Potassium carbonate | 12.0 g |
| Sodium metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Sodium Erythorbate | 0.30 g |
| Water to make | 1 liter |
| pH (adjusted with potassium hydroxide) | 10.5 |

EXAMPLE 8

An electroconductive layer, a backing layer and a back-protective layer having the following compositions were coated simultaneously on one side of the SPS support of Example 1 which were coated with the subbing layers on both sides.

| Electroconductive Layer | |
|---|---|
| $SnO_2$/Sb (9/1 weight ratio, average particle diameter, 0.25 μm) | 200 mg/m$^2$ |
| Gelatin ($Ca^{++}$ content, 3000 ppm) | 77 mg/m$^2$ |

-continued

| | |
|---|---|
| Compound A of Example 6 | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |

Backing Layer

| | |
|---|---|
| Gelatin | 2.0 g/m$^2$ |
| Compound (1) | 3 mg/m$^2$ |
| Dye a | 35 mg/m$^2$ |
| Dye b | 95 mg/m$^2$ |
| Dye c | 70 mg/m$^2$ |
| Sodium dihexyl-α-sulfosuccinate | 25 mg/m$^2$ |
| Sodium dodecylbenzenesulfonate | 35 mg/m$^2$ |
| Acetic acid | 10 mg/m$^2$ |
| 1,3-Divinylsulfonyl-2-propanol | 130 mg/m2 |

Back-Protective Layer

| | |
|---|---|
| Gelatin | 0.8 g/m$^2$ |
| Compound (1) | 1 mg/m$^2$ |
| Polymethyl methacrylate fine particles (average particle diameter, 3.4 μm) | 35 mg/m$^2$ |
| Sodium dihexyl-α-sulfosuccinate | 7 mg/m$^2$ |
| Sodium dodecylbenzenesulfonate | 10 mg/m$^2$ |
| Compound (2) | 2 mg/m$^2$ |
| Sodium acetate | 30 mg/m$^2$ |

Compound (1)

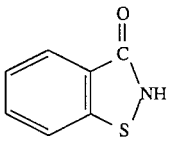

Compound (2)

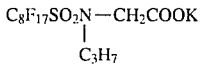

Dye a

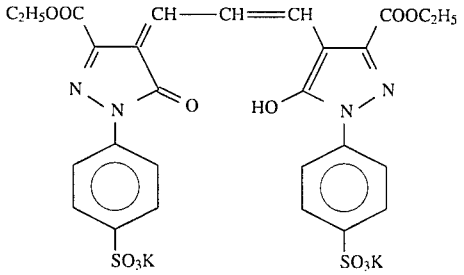

Dye b

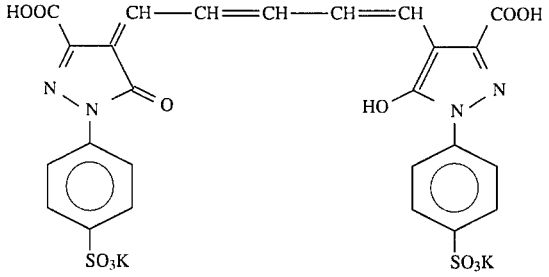

-continued

Dye c

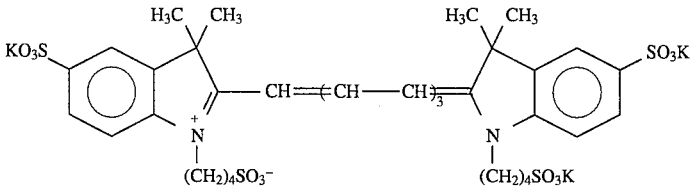

Then, the opposite surface of the support was coated with an emulsion layer and a protective layer having the following compositions simultaneously.

Emulsion Layer

A 0.13M aqueous solution of silver nitrate, and an aqueous solution of halides containing 0.04M potassium bromide, 0.09M sodium chloride, and ammonium hexachlororhodate (III) were added to an aqueous gelatin solution containing sodium chloride and 1,8-dihydroxy-3,6-dithiaoctane by the double-jet method while stirring at 45° C. for 12 minutes to effect nucleation by obtaining silver chlorobromide grains having an average grain size of 0.15 μm, and a silver chloride content of 70 mol %. Subsequently, a 0.87M aqueous solution of silver nitrate and an aqueous solution of halides containing 0.26M potassium bromide, 0.65M sodium chloride and potassium hexachloroiridate (III) were added thereto by the double-jet method over a period of 20 minutes. Then, the grains were washed with water according to the conventional flocculation method, gelatin was added thereto, and adjusted to a pH of 6.5 and a pAg of 7.5. Thereafter, 5 mg of sodium thiosulfate and 8 mg of chloroauric acid per mol of silver were added thereto and heated at 60° C. for 75 minutes to effect the chemical sensitization, followed by adding 150 mg of 1,3,3a,7-tetrazaindene as a stabilizing agent. The resulting grains contained $1.0\times10^{-7}$ mol of Rh and $6.0\times10^{-7}$ mol of Ir per mol of silver. Thus, silver chlorobromide cubic grains having an average grain size of 0.28 μm (coefficient of variation: 10%) and having a silver chloride content of 70 mol % were obtained.

To 1 kg of the emulsion thus obtained were added 60 ml of a 0.05% solution of an infrared sensitizing dye (3) and, as a supersensitizing agent and a stabilizing agent, 70 ml of a 0.5% methanolic solution of disodium 4,4'-bis-(4,6-dinaphthoxy-pyrimidine- 2-ylamino)-stilbenedisulfonate and 90 ml of a 0.5% methanolic solution of 2,5-dimethyl-3-allylbenzothiazole iodide were added thereto. Furthermore, 100 mg/m$^2$ of hydroquinone, the polymer latex Compound P-8 (particle diameter: 0.08 μm) as a plasticizer in an amount of 25% by weight to gelatin and further 78 mg/m$^2$ of 1,1'-bis(vinylsulfonyl)methane as a hardening agent were added thereto. The solution was then coated in coating amounts of 3.7 g/m$^2$ of silver and 1.8 g/m$^2$ of gelatin.

Sensitizing Dye (3)

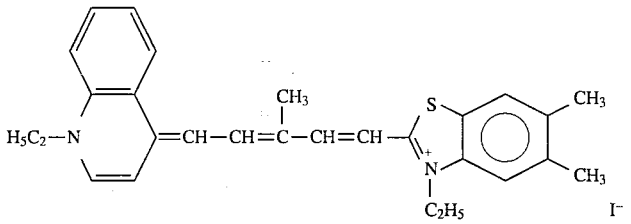

Protective Layer

| | |
|---|---|
| Gelatin | 0.7 g/m$^2$ |
| Compound (3) | 2 mg/m$^2$ |
| $SiO_2$ matting agent (average grain diameter, 3.6 μm) | 40 mg/m$^2$ |
| Compound (4) | 30 mg/m$^2$ |
| Dye C | 7 mg/m$^2$ |
| Sodium dodecylbenzenesulfonate | 30 mg/m$^2$ |
| Colloidal silica (Snowtex C, produced by Nissan Chemical Industries, Ltd.) | 10 mg/m$^2$ |
| Compound (5) | 2 mg/m$^2$ |
| Hydroquinone | 45 mg/m$^2$ |
| 1,5-Dihydroxy-2-benzaldoxime | 6 mg/m$^2$ |
| Sodium benzenethiosulfonate | 4 mg/m$^2$ |

-continued

Compound (3)

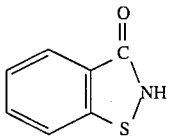

Compound (4)

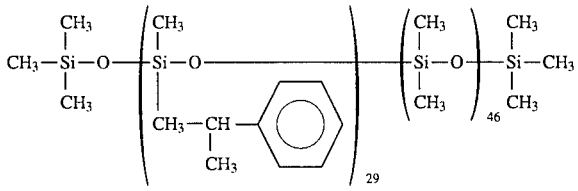

Dye C

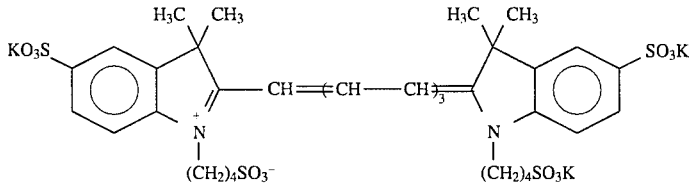

Compound (5)

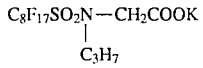

The resulting sample was cut and processed in the same manner as described in Example 5, and the exposure of a grid pattern was carried out consecutively from the 1st plate to the 4th plate using a color scanner, Lux Scan 4500, produced by Fuji Photo Film Co., Ltd. Then, the sample was subjected to the developing processing using an automatic developing machine, FG-680AG (manufactured by Fuji Photo Film Co., Ltd.), and deviation in the width of the grid pattern was measured. As a result, the deviation in the width from the 1st to 4th plates were found to be 10 μm/61 cm base length or less, indicating a good register.

In the above procedure, ambient conditions for the exposure and the development were at 25° C. and 30% RH. The development and the fixing were carried out by using Developing Solution (II) of Example 7 and Fixing Solution (I) of Example 1, respectively, and the drying condition was at 38° C. for 20 seconds and the drying temperature of 50° C.

EXAMPLE 9

An emulsion was prepared in the same manner as in Example 5, except that the sensitizing dye of the emulsion of Example 5 was changed to Sensitizing Dye (2) in an amount of 100 mg per mol of Ag, and, as a super sensitizing agent and a stabilizer, disodium 4,4'-bis(4,6-dinaphthoxy-pyrimidin-2-ylamino)-stilbenedisulfonate was added in an amount of 300 mg per mol of Ag, followed by carrying out panchromatic sensitization.

Further, the anti-foggant, colloidal silica, the plasticizer and the film hardening agent were added in the same manner as in Example 5 to prepare a coating solution of the emulsion. The solution was coated in place of the emulsion layer of Example 5 in amounts of 3.4 g/m$^2$ of silver and 1.4 g/m$^2$ of gelatin to prepare a sample.

Sensitizing Dye (2)

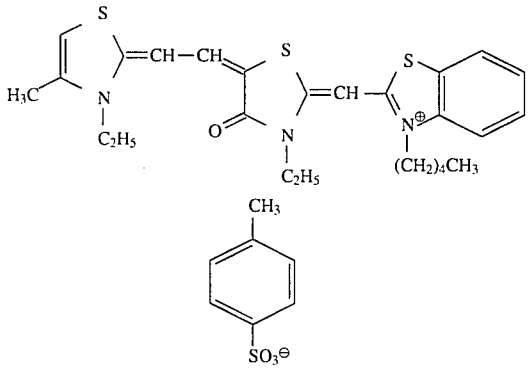

The resulting sample was cut and processed in the same manner as described in Example 5, and evaluated for the register using the direct scanner graph SG-737 (manufactured by Dainippon Screen Co., Ltd.) in place of the scanner used in Example 5. As a result, the deviation in width from the 1st plate to the 4th plate was found to be 10 μm/61 cm base length or less and a very good register was obtained.

EXAMPLE 10

A sample was prepared in the same manner as described in Example 4, except that the electroconductive layer having the following composition was coated in place of the electroconductive layer of Sample No. 32, and thereafter the backing layer and the back-protective layer of Sample No. 32 were coated, and then the first and second emulsion layers, and lower and upper protective layers having the same compositions as in Sample No. 32 were coated on the opposite side of the support.

| Electroconductive Layer | |
|---|---|
| Electroconductive polymer compound E-3 | 300 mg/m$^2$ |
| Compound (1) | 30 mg/m$^2$ |
| Compound (2) | 3 mg/m$^2$ |

The surface resistivity of the electroconductive layer was $1.4\times10^{11}$ Ω at 25° C. and 30% RH.

Compound (1)

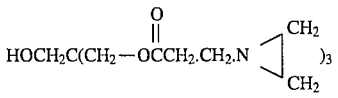

Compound (2)

$C_8H_{17}SO_3K$

The resulting sample was evaluated for the register in the same manner as in Example 1. As a result, the deviation in width of the grid pattern was found to be 12 μm/61 cm base length and a very good register was obtained.

EXAMPLE 11

One side of the SPS support of Example 1 having the subbing layers provided on both sides thereof was coated with an electroconductive layer, a backing layer and a back-protective layer having the following compositions.

| Electroconductive Layer | |
|---|---|
| $SnO_2$/Sb (9/1 weight ratio, average particle diameter, 0.25 μm) | 200 mg/m$^2$ |
| Gelatin ($Ca^{++}$ content, 3000 ppm) | 77 mg/m$^2$ |
| Compound A of Example 6 | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| Backing Layer | |
| Gelatin | 2.0 g/m$^2$ |
| Surface active agent: | |
| Sodium p-dodecylbenzenesulfonate | 40 mg/m$^2$ |
| Sodium dihexyl-α-sulfosuccinate | 40 mg/m$^2$ |
| Gelatin hardening agent: | |
| 1,2-Bis(vinylsulfonylacetamide)ethane | 200 mg/m$^2$ |
| Dye (A) | 20 mg/m$^2$ |
| Dye (B) | 50 mg/m$^2$ |
| Dye (C) | 20 mg/m$^2$ |
| Dye (D) | 30 mg/m$^2$ |
| Compound A of Example 6 | 10 mg/m$^2$ |

Dye (A)

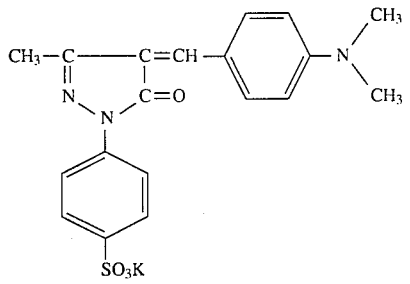

-continued

Dye (B)

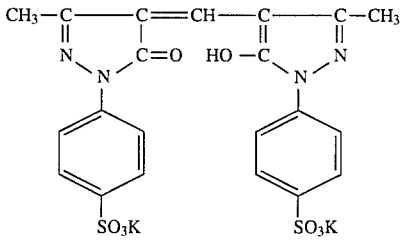

Dye (C)

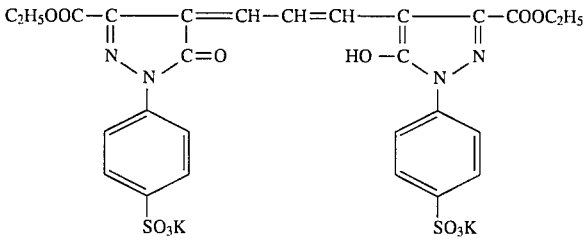

Dye (D)

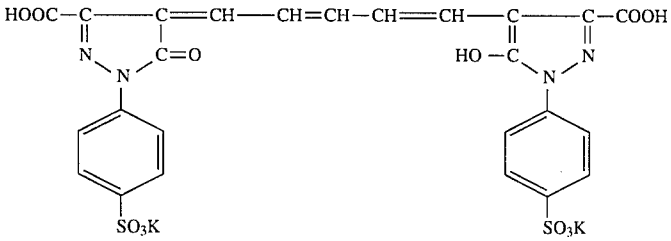

Back-Protective Layer

| | |
|---|---|
| Gelatin | 0.7 g/m$^2$ |
| Matting agent (Polymethyl methacrylate, average particle diameter, 2.5 μm) | 15 mg/m$^2$ |
| Sodium p-dodecylbenzenesulfonate | 15 mg/m$^2$ |
| Sodium dihexyl-α-sulfosuccinate | 15 mg/m$^2$ |
| Sodium acetate | 60 mg/m$^2$ |
| Compound A of Example 6 | 1 mg/m$^2$ |

Then, a lowermost layer, a first emulsion layer, an interlayer, a second emulsion layer and a protective layer having the following compositions were coated simultaneously on the opposite side of the support in the order indicated above.

| Lowermost Layer | |
|---|---|
| Gelatin | 0.2 gm$^2$ |
| Polymer latex Compound P-8 (particle diameter, 0.08 μm) | 0.2 g/m$^2$ |
| Bisvinylsulfonylmethane | 0.04 g/m$^2$ |

First Emulsion Layer

Preparation of Emulsion for Hydrazine-containing Layer and Coating Layer 250 cc of an aqueous silver nitrate solution of 63 g of silver nitrate, and 250 cc of an aqueous halide solution of 20 g of potassium bromide and 14 g of sodium chloride containing $K_2Rh(H_2O)Cl_2$ corresponding $1\times10^{-7}$ mol and $K_3IrCl_6$ corresponding to $1\times10^{-7}$ mol per mol of silver of the whole emulsions were added to a 2% aqueous gelatin solution containing sodium chloride (0.5%), 1,3-dimethyl-2-imidazolidinethione (0.002%) and citric acid (0.05%) by the double-jet method while stirring at 38° C. over a period of 12 minutes to effect nucleation by obtaining silver chlorobromide grains having an average grain size of 0.20 μm and a silver chloride content of 55 mol %. Subsequently, 450 cc of an aqueous silver nitrate solution of 107 g of silver nitrate, and 450 cc of an aqueous halide solution of 28 g of potassium bromide and 28 g of sodium chloride were added thereto by the double-jet method over a period of 20 minutes to effect grain formation.

Then, conversion was conducted by adding a KI solution in an amount of $1\times10^{-3}$ mol per mol of silver to the emulsion, followed by washing with water by the flocculation method in a usual manner. Then, 40 g of gelatin per mol of silver was added thereto, and, after adjusting a pH to 6.0 and a pAg to 7.5, 7 mg of sodium benzenethiosulfonate and 2 mg of sodium benzenesulfinate per mol of silver, and 5 mg of sodium thiosulfate and 8 mg of chloroauric acid were added to effect chemical sensitization while heating at 60° C.

for 70 minutes. Thereafter, 150 mg of 4-hydroxy-6-methyl-1,3,3a,7-tetrazaindene as a stabilizer and 100 mg of Compound A of Example 6 as a preservative were added thereto. The resulting grains had an average grain size of 0.27 μm, and were silver iodochlorobromide cubic grains having a silver chloride content of 60 mol %. (Coefficient of variation, 10%)

To the resulting emulsion were added, per mol of silver, $3\times10^{-4}$ mol of 5-[3-(4-sulfobutyl)-5-chloro-2-benzoxazolidylidene]ethylidene-1-hydroxyethoxyethyl-3-(2-phenyl)- 2-thiohidantoin potassium salt and $3\times10^{-4}$ mol of 5-[3-(4-sulfobutyl)-2-benzoxazolidylidene]ethylidene-1-hydroxyethoxyethyl- 3-(2-phenyl)-2-thiohidantoin potassium salt, further, $6\times10^{-4}$ of shortwave cyanine dye represented by the following structural formula (E), $3\times10^{-4}$ mol of 1-phenyl- 5-mercaptotetrazole, $6\times10^{-4}$ mol of a mercapto compound represented by the following structural formula (F) and a mercapto compound represented by the structural formula (G), $3\times10^{-4}$ mol of a triazine compound represented y the following structural formula (H), $3\times10^{-4}$ mol of a compound represented by the following structural formula (I), $6\times10^{-4}$ mol of 5-chloro- 8-hydroxyquinoline, and, as hydrazine compounds, $1\times10^{-3}$ mol of a compound represented by the following general formula (J) and $1\times10^{-3}$ mol of a compound represented by the general formula (K). To the emulsion were further added, in coating amounts, 30 mg/m$^2$ of N-oleyl-N-methyltaurine sodium salt, 500 mg/m$^2$ of colloidal silica (Snowrex C, a product of Nissan Chemical Industries, Ltd.) and 800 mg/m$^2$ of polymer latex Compound P-8 to prepare a coating solution for a hydrazine-containing layer. The pH value of the coating solution was adjusted to 6.0. The resulting coating solution was coated in an Ag amount of 3.5 g/m$^2$ and a gelatin amount of 1.7 g/m$^2$.

(E)

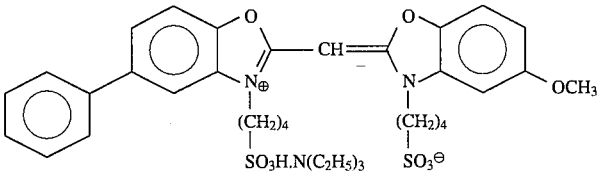

(F)

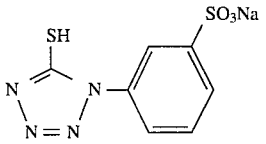

(G)

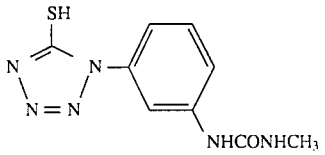

(H)

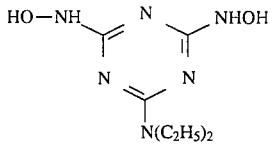

(I)

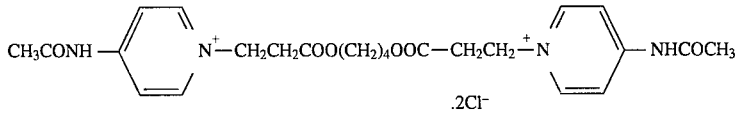

-continued (J)

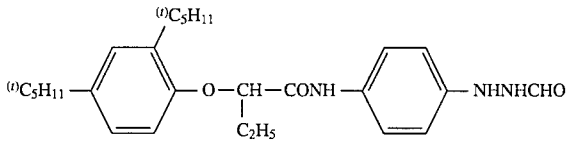

(K)

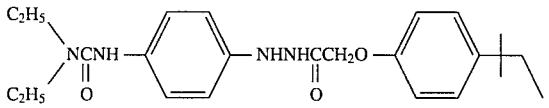

Interlayer

| | |
|---|---|
| Gelatin | 0.7 g/m$^2$ |
| Compound A of Example 6 | 3 mg/m$^2$ |
| Sodium ethanethiosulfonate | 5 mg/m$^2$ |
| Dye (L) | 100 mg/m$^2$ |
| Hydroquinone | 100 mg/m$^2$ |
| Polymer latex Compound P-8 (particle diameter, 0.08 μm) | 600 mg/m$^2$ |

Dye (L)

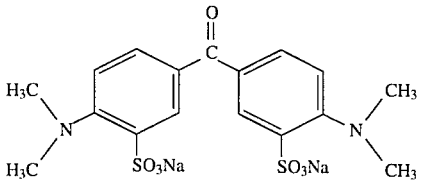

Second Emulsion Layer

Preparation of Emulsion for Redox Compound-Containing Layer and Coating Solution 700 cc of an aqueous silver nitrate solution of 170 g of silver nitrate, and 700 cc of an aqueous halide solution of 36 g of potassium bromide and 47 g of sodium chloride containing $(NH_4)_3RhCl_6$ corresponding to $3\times10^{-7}$ mol per mol of silver were added to a 2% aqueous gelatin solution containing sodium chloride (0.5%) and 1,3-dimethyl-2-imidazolidinethione (0.002%) by the double-jet method while stirring at 45° C. over a period of 30 minutes to obtain silver chlorobromide grains having an average grain size of 0.30 μm and a silver chloride content of 70 mol %. Subsequently, conversion was conducted by adding a KI solution in an amount of $1\times10^{-3}$ mol per mol of silver to the emulsion, followed by washing with water by the flocculation method in a usual manner. Then, 40 g of gelatin per mol of silver was added thereto, and, after adjusting a pH to 6.0 and a pAg to 7.5, 7 mg of sodium benenethiosulfonate and 2 mg of sodium benzenesulfinate per mol of silver, and 8 mg of chloroauric acid and 5 mg of sodium thiosulfate were added to effect chemical sensitization while heating at 60° C. for 60 minutes. Thereafter, 350 mg of 4-hydroxy-6-methyl- 1,3,3a, 7-tetrazaindene as a stabilizer and 100 mg of Compound A of Example 6 as a preservative were added thereto. The resulting grains had an average grain size of 0.30 μm, and were silver iodochlorobromide cubic grains having a silver chloride content of 70 mol %. (Coefficient of variation, 9%)

To the resulting emulsion were added, per mol of silver in the emulsion for the redox compound-containing layer, $5\times10^{-4}$ mol of 5-[3-(4-sulfobutyl)-5-chloro-2-benzoxazolidylidene]ethylidene-1-hydroxyethoxyethyl-3-(2-phenyl)- 2-thiohidantoin potassium salt, $6\times10^{-4}$ mol of a mercapto compound represented by the structural formula (F) which was added to the coating solution for the hydrazine-containing layer, $3\times10^{-4}$ mol of a triazine compound represented by the structural formula (H) and $6\times10^{-4}$ mol of 5-chloro-8-hydroxyquinoline, and, further, 10 mg/m$^2$ of a dye represented by the following general formula (M), 60 mg/m$^2$ of a redox compound represented by the following general formula (N) and polymer latex Compound P-8 (300 mg/m$^2$) and 1,2-bis(vinylsulfonylacetamido)ethane (30 mg/m$^2$) as a film hardening agent. The resulting coating solution was coated in an amount of 0.3 g/m$^2$ of Ag and an amount of 0.3 g/m$^2$ of gelatin.

(M)

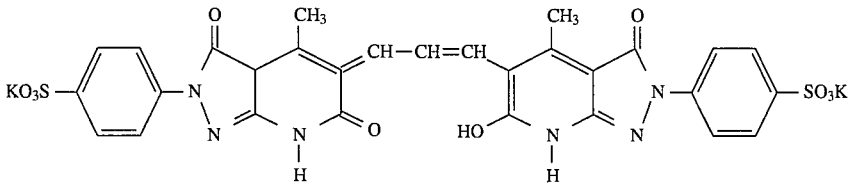

(N)

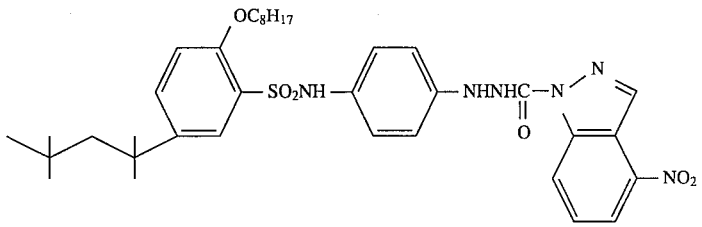

Protective Layer

| | |
|---|---|
| Gelatin | 0.15 g/m$^2$ |
| Matting agent ($SiO_2$, average particle diameter, 2.5 μm) | 50 mg/m$^2$ |
| Colloidal silica (Snowtex C, produced by Nissan Chemical Industries, Ltd.) | 100 mg/m$^2$ |
| Liquid paraffin | 50 mg/m$^2$ |
| Fluorine type surface active agent (O) | 5 mg/m$^2$ |
| Sodium p-dodecylbenzenesulfonate | 20 mg/m$^2$ |

(O)

$C_8F_{17}SO_2N(C_3H_7)CH_2COOK$

The resulting sample was evaluated for the register in the same manner as described in Example 1, except that the sample was exposed using a tungsten light source of P-6D produced by Dainippon Screen Co., Ltd. as a printer, and the development processing was conducted at 34° C. for 30 seconds. As a result, the deviation in width of the grid pattern was found to be 14 μm/61 base length, and the sample showed a very good register.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having provided thereon at least one silver halide emulsion layer, wherein the total amount of gelatin in the total hydrophilic colloid layers on the side having said emulsion layer and the total hydrophilic colloid layers on the opposite side thereto is 6 g/m$^2$ or less, and said support is a styrene polymer having a syndiotactic structure, and wherein a surface of at least one outermost layer on the side having the silver halide emulsion layer and on the opposite side thereto has a Beck surface smoothness of 4000 seconds or less.

2. A silver halide photographic material as claimed in claim 1, wherein at least one layer of the silver halide emulsion layer and other hydrophilic colloid layers contain a polymer latex.

3. A silver halide photographic material as claimed in claim 1, wherein a surface resistivity of at least one of constituting layers of said silver halide photographic material is $10^{12}$ Ω or less in an atmosphere of 25° C. and 30% RH.

* * * * *